US010228639B2

(12) United States Patent
Kogure et al.

(10) Patent No.: US 10,228,639 B2
(45) Date of Patent: Mar. 12, 2019

(54) IMAGE FORMING APPARATUS WITH A SUPPORT TO ADJUST A ROTATOR AND A GUIDE

(71) Applicants: Seiichi Kogure, Kanagawa (JP); Naohiro Kumagai, Kanagawa (JP); Junpei Fujita, Kanagawa (JP); Kazuki Yogosawa, Kanagawa (JP); Tatsuya Ohsugi, Kanagawa (JP); Kenji Sugiura, Kanagawa (JP); Yuuji Wada, Kanagawa (JP); Takehide Mizutani, Tokyo (JP)

(72) Inventors: Seiichi Kogure, Kanagawa (JP); Naohiro Kumagai, Kanagawa (JP); Junpei Fujita, Kanagawa (JP); Kazuki Yogosawa, Kanagawa (JP); Tatsuya Ohsugi, Kanagawa (JP); Kenji Sugiura, Kanagawa (JP); Yuuji Wada, Kanagawa (JP); Takehide Mizutani, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/592,006

(22) Filed: May 10, 2017

(65) Prior Publication Data

US 2017/0242371 A1 Aug. 24, 2017

Related U.S. Application Data

(63) Continuation of application No. 14/969,216, filed on Dec. 15, 2015, now Pat. No. 9,690,246.

(30) Foreign Application Priority Data

Dec. 15, 2014 (JP) ..... 2014-253108
Oct. 5, 2015 (JP) ..... 2015-197986

(51) Int. Cl.
*G03G 15/16* (2006.01)
*G03G 15/00* (2006.01)
*G03G 21/16* (2006.01)

(52) U.S. Cl.
CPC ..... *G03G 15/161* (2013.01); *G03G 15/6558* (2013.01); *G03G 15/16* (2013.01);
(Continued)

(58) Field of Classification Search
CPC ..... G03G 15/16; G03G 15/1616; G03G 15/1665; G03G 15/1675; G03G 15/168;
(Continued)

(56) References Cited

U.S. PATENT DOCUMENTS

2003/0223777 A1 12/2003 Ogashiwa
2005/0123326 A1* 6/2005 Ito ..... G03G 15/01 399/313

(Continued)

FOREIGN PATENT DOCUMENTS

CN 1808306 A 7/2006
CN 1831671 A 9/2006

(Continued)

OTHER PUBLICATIONS

U.S. Appl. No. 14/802,374, filed Jul. 17, 2015.

(Continued)

*Primary Examiner* — Joseph S Wong
(74) *Attorney, Agent, or Firm* — Oblon, McClelland, Maier & Neustadt, L.L.P.

(57) ABSTRACT

An image forming apparatus includes a belt-shaped image bearer, a transferer, a guide, two rotators, and a support. The image bearer has an image bearing surface to bear an image thereon. The transferer forms a transfer section between the transferer and the image bearer, to transfer the image onto a recording medium. The guide is disposed upstream from the (Continued)

transfer section in a delivery direction of the recording medium, to guide the recording medium toward the transfer section. The two rotators are disposed upstream from the transfer section in a moving direction of the image bearer and in contact with a non-image bearing surface of the image bearer opposite to the image bearing surface, a first rotator being closer to the transfer section than a second rotator. The support supports the first rotator and the guide and adjusts a position of the first rotator and a position of the guide.

15 Claims, 22 Drawing Sheets

(52) U.S. Cl.
CPC ..... *G03G 15/1605* (2013.01); *G03G 15/168* (2013.01); *G03G 15/1615* (2013.01); *G03G 15/1665* (2013.01); *G03G 15/1675* (2013.01); *G03G 15/1695* (2013.01); *G03G 15/6529* (2013.01); *G03G 15/6555* (2013.01); *G03G 21/1647* (2013.01); *G03G 2215/00409* (2013.01); *G03G 2215/0129* (2013.01); *G03G 2221/1642* (2013.01)

(58) Field of Classification Search
CPC ..... G03G 15/1695; G03G 15/6529; G03G 15/6555; G03G 21/1647; G03G 2215/00409; G03G 2221/1642
See application file for complete search history.

(56) References Cited

U.S. PATENT DOCUMENTS

| | | | | |
|---|---|---|---|---|
| 2009/0279927 | A1 | 11/2009 | Fujita | |
| 2010/0067952 | A1 | 3/2010 | Fujita et al. | |
| 2011/0026954 | A1* | 2/2011 | Kishi | G03G 15/161 399/44 |
| 2011/0064487 | A1 | 3/2011 | Ichihashi et al. | |
| 2011/0206399 | A1 | 8/2011 | Fujita et al. | |
| 2012/0027475 | A1* | 2/2012 | Ohba | G03G 15/1605 399/316 |
| 2012/0224879 | A1 | 9/2012 | Fujita et al. | |
| 2012/0237260 | A1 | 9/2012 | Sengoku et al. | |
| 2013/0114982 | A1 | 5/2013 | Ichihashi et al. | |
| 2014/0199089 | A1 | 7/2014 | Ishikawa | |
| 2014/0199104 | A1 | 7/2014 | Ishikawa | |
| 2015/0268591 | A1 | 9/2015 | Fujita et al. | |

FOREIGN PATENT DOCUMENTS

| | | |
|---|---|---|
| CN | 103926816 A | 7/2014 |
| JP | 2011-033826 | 2/2011 |
| JP | 2011-064823 | 3/2011 |
| JP | 2011-112774 | 6/2011 |

OTHER PUBLICATIONS

Combined Office Action and Search Report dated Dec. 29, 2017 in Patent Application No. 201510881997.0 (with English translation of categories of cited documents). 9 pages.

* cited by examiner

IMAGE FORMING APPARATUS WITH A SUPPORT TO ADJUST A ROTATOR AND A GUIDE

CROSS-REFERENCE TO RELATED APPLICATIONS

This application is a continuation of U.S. application Ser. No. 14/969,216, filed on Dec. 15, 2015, and is based upon and claims the benefit of foreign priority from Japanese Patent Application No. 2014-253108, filed on Dec. 15, 2014, and from Japanese Patent Application No. 2015-197986, filed on Oct. 5, 2015. The entire contents of each of the above applications are incorporated herein by reference in entirety.

BACKGROUND

Technical Field

Aspects of this disclosure relate to an image forming apparatus.

Related Art

An electrophotographic image forming apparatus includes, for example, a belt-shaped image bearer to rotate with an image borne thereon, a transferer disposed opposing the image bearer, and a transfer section between the image bearer and the transferer to transfer the image from image bearer onto a recording medium delivered. Such an image forming apparatus may include a guide member upstream from the transfer section in a delivery direction of the recording medium, to guide entry of the recording medium into the transfer section. A recording medium is guided with the guide toward the transfer section. When the recording medium passes the guide, the leading or trailing end of the recording medium may contact the image bearer. Such contact of the leading or trailing end of the recording medium against the image bearer may inwardly displace the image bearer in rotation, depending on the degree of contact, thus causing unnecessary vibration.

SUMMARY

In an aspect of this disclosure, there is provided an image forming apparatus that includes a belt-shaped image bearer, a transferer, a guide unit, and a plurality of contact members. The belt-shaped image bearer has an image bearing surface to bear an image thereon. The transferer forms a transfer section between the transferer and the image bearer, to transfer the image onto a recording medium. The guide unit is disposed upstream from the transfer section in a delivery direction of the recording medium, to guide the recording medium toward the transfer section. The plurality of contact members are disposed side by side at positions opposing the guide unit and in contact with a non image bearing surface of the image bearer opposite to the image bearing surface.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

DETAILED DESCRIPTION

Figure 1:
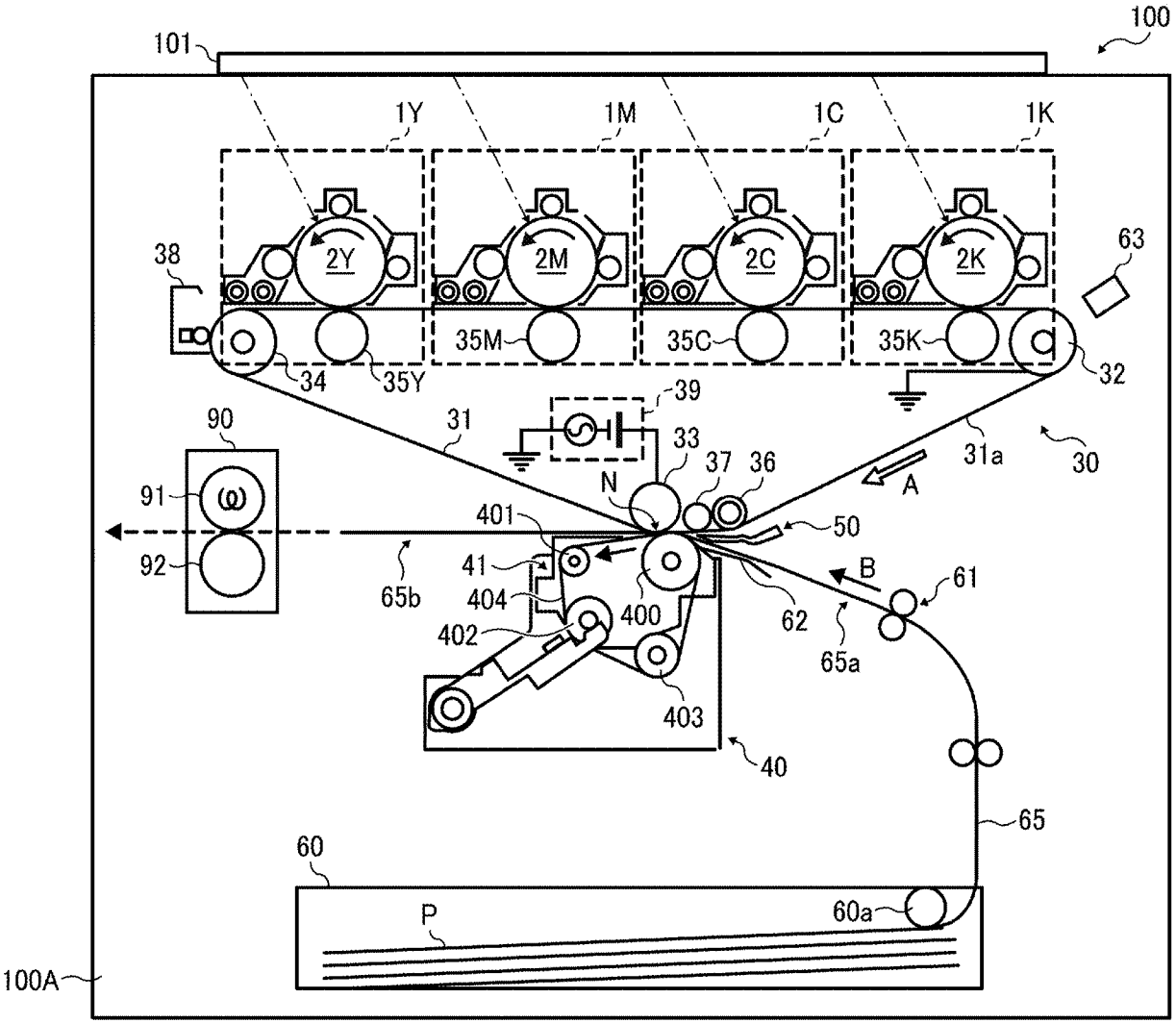
FIG. 1 is a schematic view of a configuration of an image forming apparatus according to an embodiment of this disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Below, embodiments and variations of the present disclosure are described with reference to drawings. In the embodiments and variations described below, the same reference numerals are given to components having the same functions and configuration, and the descriptions thereof are omitted as needed. In the drawings attached, components may partially be omitted for ease of understanding. It is to be noted that suffixes Y, M, C, and K denote colors yellow, magenta, cyan, and black, respectively. These suffixes may be omitted unless otherwise specified.

Below, a description is given of an image forming apparatus 100 according to an embodiment of the present disclosure. In this embodiment, the image forming apparatus 100 is illustrated as an electrophotographic color printer. Below, a configuration of an image forming apparatus 100 according to an embodiment of the present disclosure is described with reference to FIG. 1. FIG. 1 is a schematic view of the image forming apparatus 100 according to an embodiment of the present disclosure. As illustrated in FIG. 1, the image forming apparatus 100 includes four image forming units 1Y, 1M, 1C, and 1K to form toner images of yellow, magenta, cyan, and black, respectively. It is to be noted that the suffixes Y, M, C, and K denote colors of yellow, magenta, cyan, and black, respectively. To simplify the description, the suffixes Y, M, C, and K indicating colors may be omitted herein, unless colors distinguished. The image forming apparatus 100 includes a transfer unit 30 serving as a transfer device, an optical writing unit 101 serving as an exposure device, a fixing device 90, a media tray 60 to store recording media P, and a pair of registration rollers 61. The image forming units 1Y, 1M, 1C, and 1K all have the same configuration as all the others, differing only in the color of toner employed as a powder-form developing agent. The image forming units 1Y, 1M, 1C, and 1K are replaced upon reaching their product life cycles. According to the embodiment, the image forming units 1Y, 1M, 1C, and 1K are detachably attachable relative to an apparatus body 100A of the image forming apparatus 100 to be replaceable.

Figure 2:
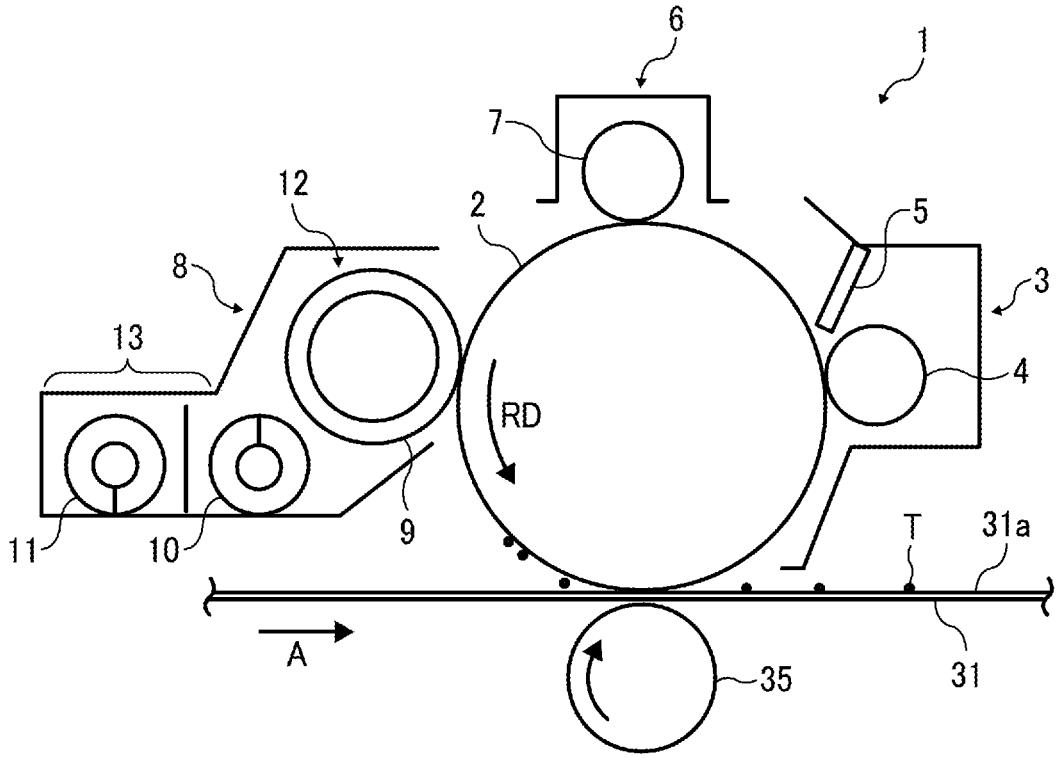
FIG. 2 is an enlarged view of an image forming unit in the image forming apparatus illustrated in FIG. 1.

FIG. 2 is an enlarged view of one of the image forming units 1Y, 1M, 1C, and 1K as a representative example. The image forming units 1Y, 1M, 1C, and 1K all have the same configuration as all the others, differing only in the color of toner employed. Thus, the description is provided without the suffixes Y, M, C, and K indicating colors unless differentiation of the color is necessary. The image forming unit 1 includes a drum-shaped photoconductor 2 serving as a latent image bearer, a photoconductor cleaner 3, a static eliminator, a charging device 6, a developing device 8, and so forth. Such devices are held in a common casing so that they are detachably installable all together relative to the apparatus body 100A, thereby constituting a process cartridge replaceable as a single unit.

The photoconductor 2 includes a drum-shaped base and an organic photosensitive layer on a surface of the base. The photoconductor 2 is rotated in a clockwise direction indicated by arrow RD in FIG. 2 by a driving device, The charging device 6 includes a charging roller 7 serving as a charge member to which a charging bias is applied. The charging roller 7 contacts or approaches the photoconductor 2 to generate an electrical discharge therebetween, thereby charging uniformly the surface of the photoconductor 2. Instead of using the charge member, e.g., the charging roller 7 that contacts or disposed close to the photoconductor 2, for example, a corona charger that does not contact the photoconductor 2 may be employed.

The uniformly charged surface of the photoconductor 2 by the charging roller 7 is scanned by exposure light such as a light beam projected from the optical writing unit 101, thereby forming an electrostatic latent image for black on the surface of the photoconductor 2. The electrostatic latent image on the photoconductor 2 is developed with toner T of the respective color by the developing device 8. Accordingly, a visible image, also known as a toner image, is formed. The toner image formed on the photoconductor 2 is transferred primarily onto an intermediate transfer belt 31 formed into an endless loop.

The photoconductor cleaner 3 removes residual toner remaining on the surface of the photoconductor 2 after a primary transfer process, that is, after the photoconductor 2 passes through a primary transfer nip between the intermediate transfer belt 31 and the photoconductor 2. The photoconductor cleaner 3 includes a cleaning brush roller 4 which is rotated and a cleaning blade 5. The cleaning blade 5 is cantilevered, that is, one end thereof is fixed to a housing of the photoconductor cleaner 3, and the other end is a free end that contacts the surface of the photoconductor 2. The cleaning brush roller 4 rotates and brushes off the residual toner from the surface of the photoconductor 2 while the cleaning blade 5 scraping off the residual toner from the surface. The static eliminator may employ a known static eliminating device and removes residual charge remaining on the photoconductor 2 after the surface thereof is cleaned by the photoconductor cleaner 3 in preparation for the subsequent imaging cycle. The surface of the photoconductor 2 is initialized by the charge removing operation in preparation for the subsequent imaging cycle.

The developing device 8 includes a developing section 12 and a developer conveyor 13. The developing section 12 includes a developing roller 9 inside thereof. The developer conveyor 13 stirs and transports the developing agent. The developer conveyor 13 includes a first chamber equipped with a first screw 10 and a second chamber equipped with a second screw 11. The first screw 10 and the second screw 11 are rotatably supported by, e.g., a casing of the developing device 8. The first screw 10 and the second screw 11 are rotated to deliver the developing agent to the developing roller 9 while circulating the developing agent.

As illustrated in FIG. 1, the optical writing unit 101 to write latent images on the photoconductors 2 is disposed above the image forming units 1Y 1M, 1C, and 1K. Based on image information received from an external device such as a personal computer (PC), the optical writing unit 101 optically scans the photoconductors 2Y, 2M, 2C, and 2K with a light beam projected from a laser diode of the optical writing unit 101. Accordingly, the electrostatic latent images of yellow, magenta, cyan, and black are formed on the photoconductors 2Y 2M, 2C, and 2K, respectively.

Referring back to FIG. 1, a description is provided of the transfer unit 30. The transfer unit 30 serving as a belt unit and a transfer device is disposed substantially below the image forming units 1Y, 1M, 1C, and 1K. The transfer unit 30 includes the intermediate transfer belt 31 serving as an image bearer formed into an endless loop and rotated in the clockwise direction. A direction of rotary movement of the intermediate transfer belt 31 is referred to as a belt movement direction indicated by arrow A in FIG. 1. Besides the intermediate transfer belt 31 serving as the belt-shaped image bearer, the transfer unit 30 further includes a plurality of rollers: a drive roller 32, a secondary-transfer back surface roller 33, a cleaning auxiliary roller 34, four primary transfer rollers 35Y, 35M, 35C, and 35K, and rollers 36 and 37 serving as two rotators. The primary transfer rollers 35Y, 35M, 35C. and 35K (which may be referred to collectively as primary transfer rollers 35) are disposed opposite the photoconductors 2Y, 2M, 2C, and 2K, respectively, via the intermediate transfer belt 31. The drive roller 32, the secondary-transfer back surface roller 33, the cleaning auxiliary roller 34 are rollers around which the intermediate transfer belt 31 is rotatably wound, and are also support rotators to support the intermediate transfer belt 31. The rollers 36 and 37 are multiple contact members and may also be referred to as pressing rollers. The transfer unit 30 is detachably attachable (replaceable) relative to the apparatus body 100A. A secondary transfer unit 41 and a belt cleaning device 38 are disposed outside the loop formed by the intermediate transfer belt 31. The secondary transfer unit 41 includes a secondary transfer belt 404 serving as an image bearer and also as a secondary transferer. The secondary-transfer back surface roller 33 can be also referred to as a secondary-transfer opposed roller.

The intermediate transfer belt 31 has a front surface 31*a* serving as an image bearing surface to bear a toner image thereon. The intermediate transfer belt 31 is looped around and stretched taut between the plurality of rollers, i.e., the drive roller 32, the secondary-transfer back surface roller 33, the cleaning auxiliary roller 34, the four primary transfer rollers 35Y, 35M, 35C, and 35K, and the rollers 36 and 37. The drive roller 32 is rotated in the clockwise direction by a driving device, such as a drive motor, and rotation of the drive roller 32 causes the intermediate transfer belt 31 to rotate in the same direction. In the transfer unit 30, the intermediate transfer belt 31 is looped around the plurality of rollers, thereby delivering a recording medium P.

The intermediate transfer belt 31 is interposed between the primary transfer rollers 35Y, 35M, 35C, and 35K, and the photoconductors 2Y, 2M, 2C, and 2K, thereby forming primary transfer nips serving as transfer sections for each color between a front surface 31*a* or an image bearing face of the intermediate transfer belt 31 and the photoconductors 2Y, 2M, 2C, and 2K. A primary transfer bias is applied to the primary transfer rollers 35Y, 35M, 35C, and 35K by a transfer bias power source. Accordingly, a primary transfer electric field is formed between the primary transfer rollers 35Y, 35M, 35C, and 35K, and the toner images of yellow, magenta, cyan, and black formed on the photoconductors 2Y, 2M, 2C, and 2K, An yellow toner image formed on the photoconductor 2Y enters the primary transfer nip for yellow as the photoconductor 2Y rotates. Subsequently, the yellow toner image is primarily transferred from the photoconductor 2Y to the intermediate transfer belt 31 by the transfer electric field and the nip pressure. The intermediate transfer belt 31, on which the yellow toner image has been transferred, passes through the primary transfer nips of magenta, cyan, and black. Subsequently, a magenta toner image, a cyan toner image, and a black toner image on the photoconductors 2M, 2C, and 2K, respectively, are superimposed on the yellow toner image which has been transferred on the intermediate transfer belt 31, one atop the other in the primary transfer process, Accordingly, a composite toner image, in which the toner images of four different colors are superimposed on one atop the other, is formed on the surface of the intermediate transfer belt 31 in the primary transfer process. According to the present embodiment, roller-type primary transferors, that is, the primary transfer rollers 35Y, 35M, 35C, and 35K, are employed as primary transferors, Alternatively, a transfer charger and a brush-type transferer may be employed as the primary transferer.

The secondary transfer unit 41 is disposed outside the loop of the intermediate transfer belt 31. A nip forming roller 400 of the transfer unit 30 is disposed outside the loop formed by the intermediate transfer belt 31, opposite to the secondary-transfer back surface roller 33. The intermediate transfer belt 31 is interposed between the secondary-transfer back surface roller 33 and the nip forming roller 400, thereby forming a secondary transfer nip N serving as a transfer section at which the front surface 31*a* of the intermediate transfer belt 31 contacts the secondary transfer belt 404. A secondary transfer bias is applied to the secondary-transfer back surface roller 33 by a secondary-transfer bias power source 39 (hereinafter referred to as power source 39). With this configuration, a secondary-transfer electrical field is formed between the secondary-transfer back surface roller 33 and the secondary transfer belt 404 so that the toner T having a negative polarity is moved electrostatically from the secondary-transfer back surface roller 33 to the secondary transfer belt 404. In other words, the secondary transfer belt 404 serving as secondary transferor forms the secondary transfer nip N between the secondary transfer belt 404 and an image bearing surface 21A, to transfer a toner image on a recording medium P.

As illustrated in FIG. 1, the media tray 60 to store a bundle of recording media. P, such as paper sheets or resin sheets, is disposed below the transfer unit 30. The media tray 60 is equipped with a feed roller 60*a* to contact a topmost one of recording media P in the media tray 60. The feed roller 60*a* is rotated at predetermined timing to pick up and send the topmost one of the recording media P from the media tray 60 to a delivery path 65 in the secondary transfer nip N. On the delivery path 65 are disposed a pair of conveyance rollers, the pair of registration rollers 61, a lower guide 62, and an upper guide unit 50 (hereinafter referred to as the guide unit 50) serving as a guide unit. Of the delivery path 65, a delivery path between the pair of registration rollers 61 and the secondary transfer nip N is referred to as a pre-nip delivery path 65*a*. The pair of registration rollers 61 is rotated to feed a recording medium P to the secondary transfer nip N so that the four-color superimposed toner images on the front surface 31*a* of the intermediate transfer belt 31 are synchronously transferred on a recording medium P fed from the media tray 60 into the secondary transfer nip N.

In the transfer unit 30, the intermediate transfer belt 31 is an endless looped belt serving as an image bearer to bear a toner image transferred thereon. In the transfer unit 30, the intermediate transfer belt 31 is looped around and supported with the plurality of rollers, i.e., the drive roller 32, the secondary-transfer back surface roller 33, the cleaning auxiliary roller 34, and the rollers 36 and 37. Accordingly, the transfer unit 30 acts as a belt unit to deliver the toner images transferred on the intermediate transfer belt 31 to the secondary transfer nip N serving as a transfer section at which the toner image is transferred from the intermediate transfer belt 31 to the recording medium P in the secondary transfer process.

In the secondary transfer nip N, the recording medium P tightly contacts the composite toner image on the front surface 31*a* of the intermediate transfer belt 31, and the four-color superimposed toner images are collectively transferred onto the recording medium P by a secondary transfer electric field and a nip pressure applied thereto, thereby forming a full-color toner image in combination with white color of the recording medium P. After passage of the secondary transfer nip N, untransfered residual toner remains on the intermediate transfer belt 31. The residual toner is removed from the intermediate transfer belt 31 by the belt cleaning device 38 which contacts the front surface 31*a* of the intermediate transfer belt 31. The cleaning auxiliary roller 34 inside the loop formed by the intermediate transfer belt 31 supports the cleaning operation performed by the belt cleaning device 38. A potential sensor 63 is disposed outside the loop formed by the intermediate transfer belt 31. More specifically, of the entire circumferential area of the intermediate transfer belt 31, the potential sensor 63 is disposed opposite to a portion of the intermediate transfer belt 31 wound around the drive roller 32 with a predetermined gap between the potential sensor 63 and the intermediate transfer belt 31. The surface potential of the toner image primarily transferred onto the intermediate transfer belt 31 is measured with the potential sensor 63 when the toner image comes to a position opposite to the potential sensor 63.

A post-nip delivery path 65*b* is disposed downstream of the secondary transfer nip N in a direction of delivery of a recording medium P indicated by arrow B (hereinafter, the delivery direction B). Hereinafter, the downstream side in the delivery direction B of the recording medium P is referred to as a downstream, side in the delivery direction. The downstream side in the delivery direction means a left side of the secondary transfer nip Nin FIG. 1. The fixing device 90 is disposed on the post-nip delivery path 65*b*. The recording medium P having the composite toner image transferred thereon is delivered into the fixing device 90. The fixing device 90 includes a fixing roller 91 including a heat source inside thereof and a pressing roller 92. The fixing roller 91 and the pressing roller 92 contact to form a fixing nip where heat and pressure are applied. The composite toner image is softened and fixed on the recording medium P as the recording medium P passes through the fixing nip. After the toner image is fixed on the recording medium P, the recording medium P is delivered from the fixing device 90. Subsequently, the recording medium P is ejected outside the apparatus body 100A via the post-nip delivery path 65*b*.

In the apparatus body 100A, the secondary transfer unit 41 is supported with a first support assembly 40. The first support assembly 40 detachably supports the secondary transfer unit 41. The secondary transfer unit 41 is replaceable independently as a single unit. The secondary transfer unit 41 includes the nip forming roller 400 serving as a rotator and a transferer disposed opposite to the secondary-transfer back surface roller 33 via the intermediate transfer belt 31. The secondary transfer unit 41 includes three rollers 401, 402, and 403 serving as three rotators, and a secondary transfer belt 404 looped around the nip forming roller 400 and three rollers 401, 402, and 403. The secondary transfer belt 404 serves as an image bearer and a transferer. In other words, the secondary transfer unit 41 is a belt conveyor unit in which the secondary transfer belt 404 is an endless looped belt serving as an image bearer, and is looped around the plurality of rollers, i.e., the nip forming roller 400 and the rollers 401, 402, and 403. The nip forming roller 400 is also referred as a secondary transfer roller.

The nip forming roller 400 secondarily transfers the toner image from the front surface 31*a* of the intermediate transfer belt 31 onto the recording medium P. The nip forming roller 400 is disposed inside the belt loop of the secondary transfer belt 404, facing to the secondary-transfer back surface roller 33. The intermediate transfer belt 31 and the secondary transfer belt 404 are interposed between the nip forming roller 400 and the secondary-transfer back surface roller 33. The nip forming roller 400 is biased against the secondary transfer belt 404 so as to pressingly contact the secondary transfer belt 404, thereby forming the secondary transfer nip N between the intermediate transfer belt 31 and the secondary transfer belt 404.

In this embodiment, the power source 39 applies bias for secondary transfer (secondary transfer bias) to the secondary-transfer back surface roller 33. In some embodiments, the power source 39 applies secondary transfer bias to the nip forming roller 400. In a case in which the secondary transfer bias is applied to the nip forming roller 400, the secondary transfer bias having a polarity opposite that of the toner is applied to the nip forming roller 400. In a case in which the secondary transfer bias is applied to the secondary-transfer back surface roller 33, the secondary transfer bias having the same polarity as that of the toner is applied to the secondary-transfer back surface roller 33. The roller 401 is to strip the recording medium P, which is electrostatically attracted to the secondary transfer belt 404, from the secondary transfer belt 404 by self stripping along the curvature of the roller 401.

Figure 20A:
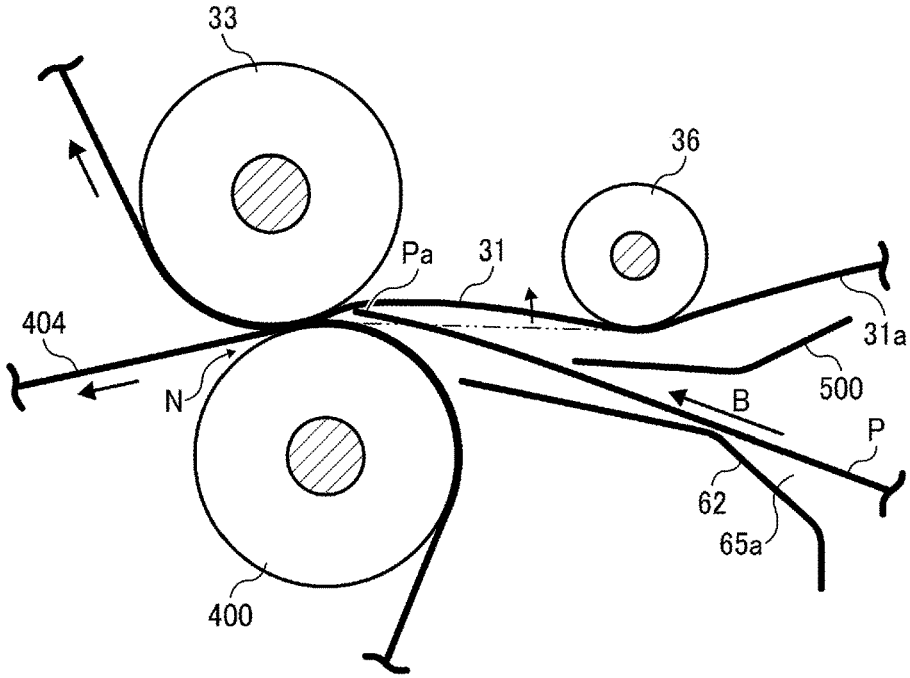
FIG. 20A is an enlarged view of a state in which a leading end of a recording medium has passed a first guide and a second guide according to a comparative example.
Figure 20B:
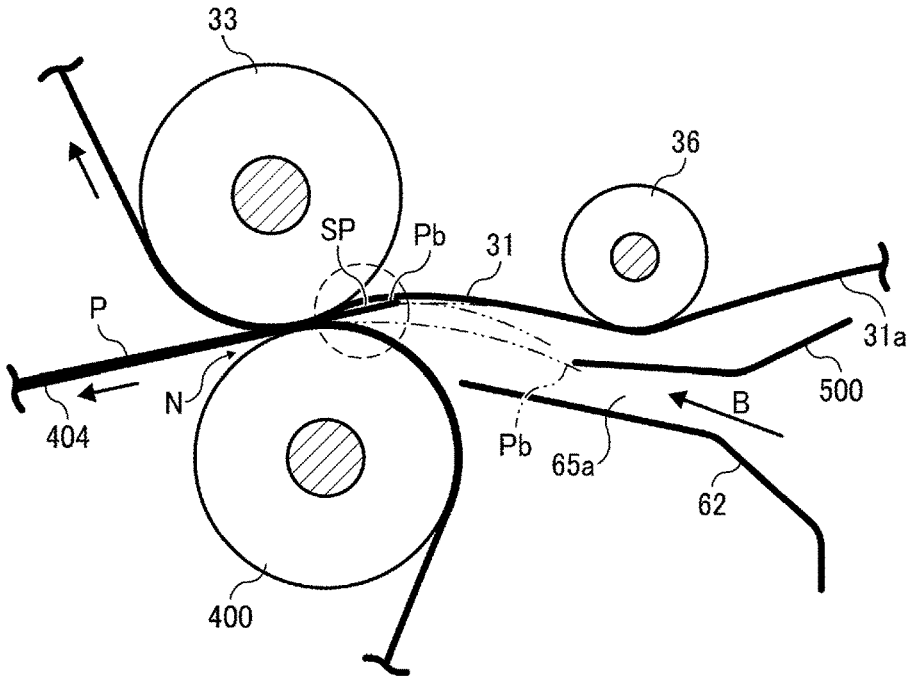
FIG. 20B is an enlarged view of a state in which a trailing end of the recording medium has passed the first guide according to the comparative example.

Next, a description is given of a configuration of an upstream side from the secondary transfer nip N in the delivery direction B. FIGS. 20A and 20B are schematic views of a configuration of a comparative example of the upstream side from the secondary transfer nip N in the delivery direction B. In the comparative example, the lower guide 62 is disposed below the pre-nip delivery path 65*a* disposed between the secondary transfer nip N and the pair of registration rollers 61 in the delivery direction B. An upper guide 500 is also disposed above the pre-nip delivery path 65*a* and opposite the lower guide 62. A roller 36 is disposed upstream from the secondary-transfer back surface roller 33 in the delivery direction B and in contact with a back surface 31*b* serving as a non image bearing face of the intermediate transfer belt 31. A recording medium P delivered to the secondary transfer nip N is originally flat. However, the recording medium P is deformed by contact with the delivery path 65 and/or the upper guide 500 and is likely to be delivered in a curled state. In other words, the recording medium P is curled toward a front surface (image transferred surface) of the recording medium P between the pair of registration rollers 61 and the secondary transfer nip N. In such a configuration, as illustrated in FIG. 20A, a leading end Pa of the recording medium P fed between the lower guide 62 and the upper guide 500 passes the upper guide 500 and contacts the front surface 31*a* of the intermediate transfer belt 31 between the roller 36 and the secondary transfer nip N. The contact of the leading end Pa of the recording medium P presses the intermediate transfer belt 31 toward the inside of the belt loop and fluctuates the intermediate transfer belt 31. In such a case, the recording medium P and the intermediate transfer belt 31 (the front surface 31*a*) repeats contact and separation, thus disturbing toner images or a transferred composite image and causing an abnormal image.

When the recording medium P is further delivered, the leading end Pa is guided into the secondary transfer nip N. The front surface 31*a* of the intermediate transfer belt 31 and the recording medium P tightly contact each other and enter the secondary transfer nip N. After a trailing end Pb of the recording medium P passes the upper guide 500, as illustrated in FIG. 20B, the trailing end Pb of the recording medium P curls toward the intermediate transfer belt 31 and contacts the front surface 31*a*. In this case, if the contact of the trailing end Pb of the recording medium P against the front surface 31*a* is moderate, it does not matter. However, the way of curling varies depending on the strength (thickness) or delivery speed of the recording medium P. If the recording medium P strongly hits the front surface 31*a* of the intermediate transfer belt 31, the recording medium P would be rapidly pushed up toward the inside of the loop of the intermediate transfer belt 31. As a result, the front surface 3 la of the intermediate transfer belt 31 with the trailing end Pb of the recording medium P would not tightly contact each other. Then, if a space SP is formed between the trailing end Pb and the front surface 31*a* at a position upstream from the secondary transfer nip N in the delivery direction B, a secondary transfer bias would cause an electric discharge in the space SP, thus resulting in an abnormal image due to disturbance of toner images.

Hence, in this embodiment, as illustrated in FIGS. 3 through 6, the guide unit 50 including a first guide 51 and, a second guide 52 is disposed above the pre-nip delivery path 65*a*, which is disposed upstream from the secondary transfer nip N in the delivery direction B of a recording medium P. The guide unit 50 guides the recording medium P delivered toward the secondary transfer nip N. In other words, the first guide 51 acts as a functional member to press a leading end Pa or the entire of a recording medium P, and the second guide 52 acts as a functional member to reduce an impact caused by the trailing end Pb of the recording medium P which is returning from a curled state to a flat state. Accordingly, in this embodiment, the leading end Pa and the trailing edge Pb of the recording medium P are guided with two separate guides, the first guide 51 and the second guide 52, which differ from the comparative example in which a single guide, the upper guide 500, guides the leading end Pa and the trailing edge Pb.

Figure 3:
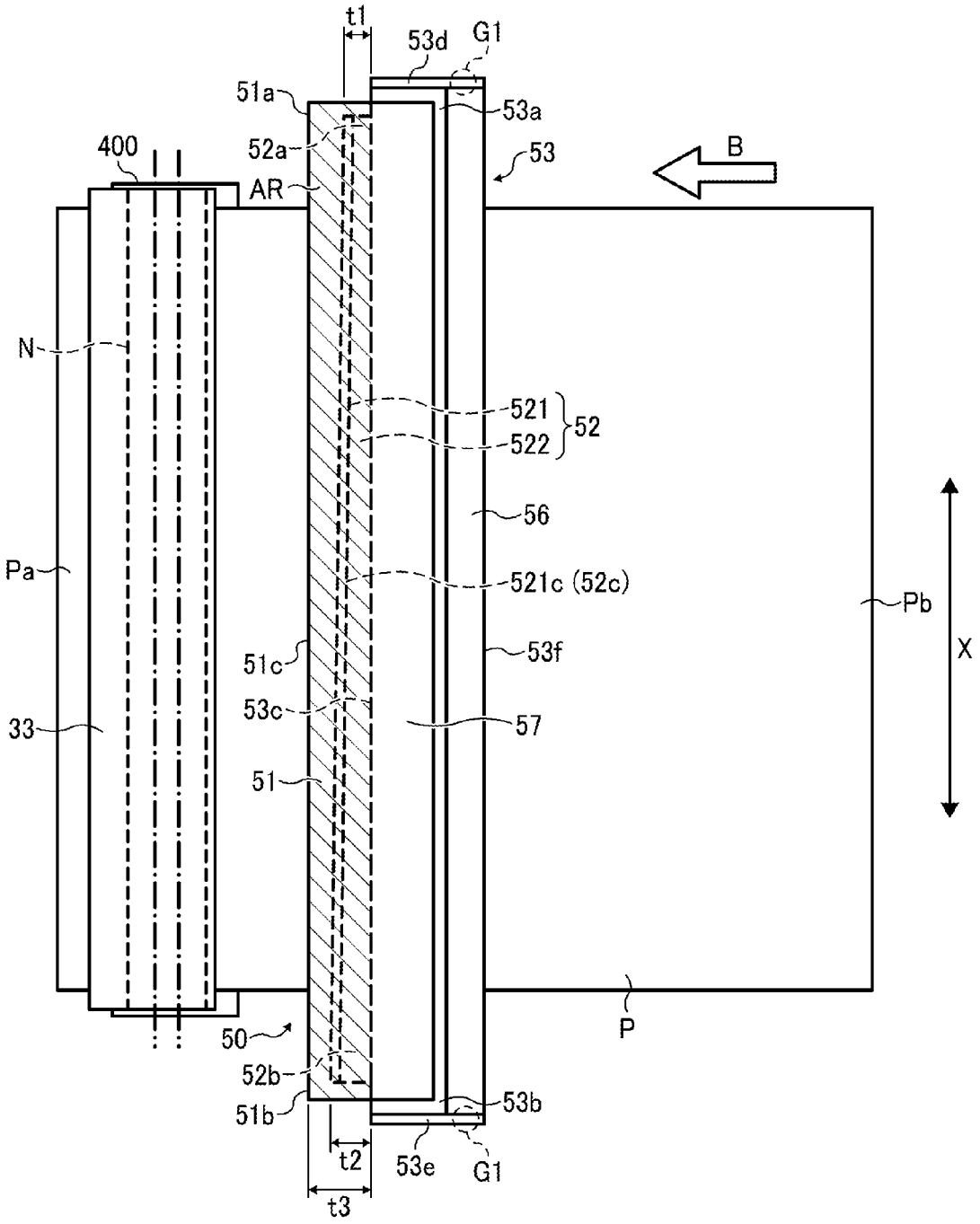
FIG. 3 is a plan view of the configuration and arrangement of a first guide and a second guide constituting a guide unit according to an embodiment of this disclosure.

The guide unit 50 includes the mount 53 made of metal and the first guide 51 and the second guide 52 mounted on the mount 53. The first guide 51 and the second guide 52 are film members made of resin. As illustrated in FIG. 3, the first guide 51 is disposed upstream from the secondary transfer nip N in the delivery direction B of a recording medium P and opposite the front surface 31*a* of the intermediate transfer belt 31 (see FIG, 7), to guide the recording medium P toward the secondary transfer nip N. The second guide 52 is disposed upstream from the first guide 51 in the delivery direction B of the recording medium P, and a portion of the second guide 52 is disposed opposite the first guide 51 to guide the recording medium P toward the secondary transfer nip N. In other words, the second guide 52 is disposed upstream from the first guide 51 in the delivery direction B and away from the first guide 51. The first guide 51 and the second guide 52 also regulate movement of the recording medium P toward the front surface 31*a* of the intermediate transfer belt 31.

Figure 4:
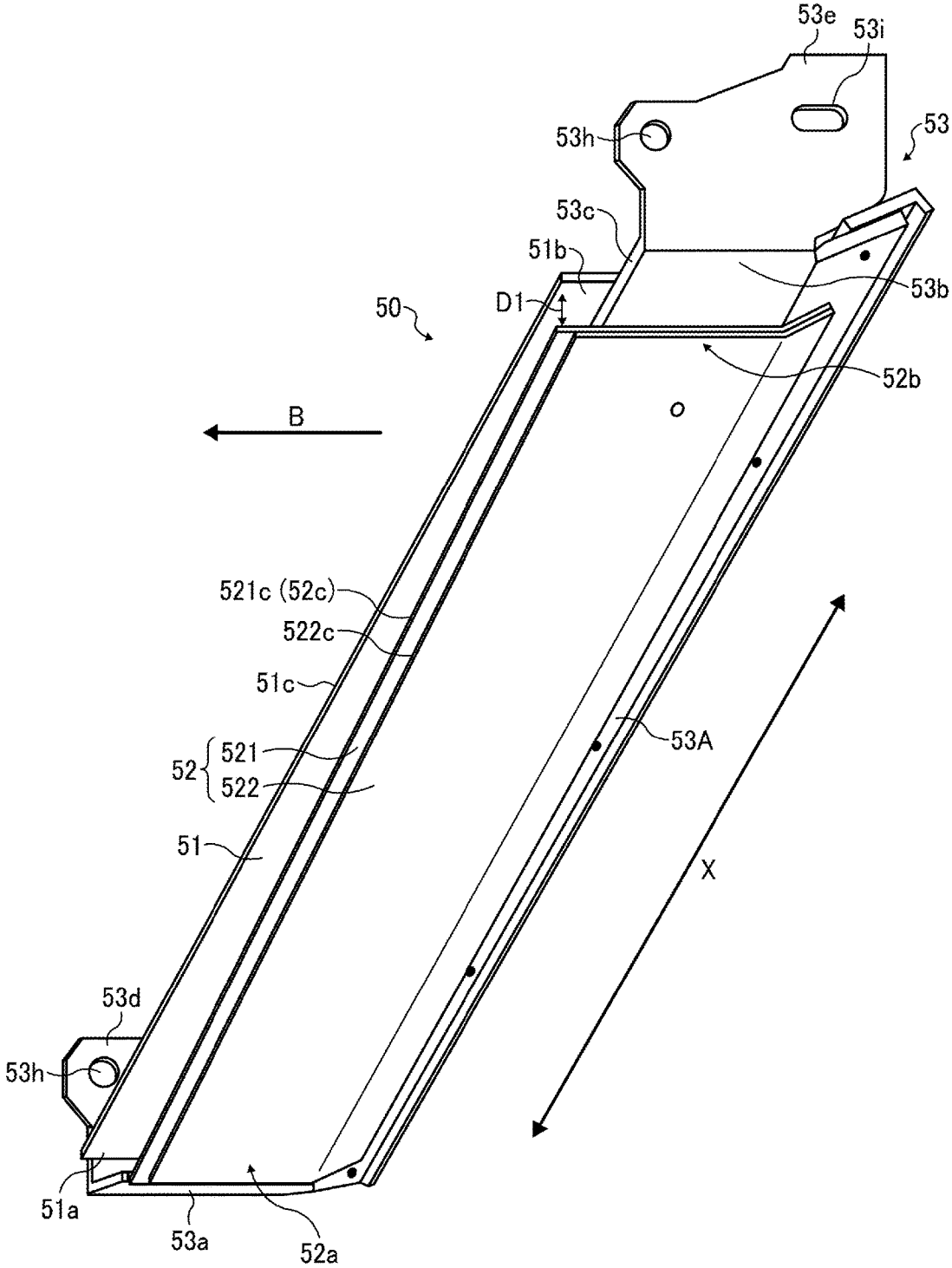
FIG. 4 is an enlarged perspective view of the first guide and the second guide of FIG. 3.

As illustrated in FIGS. 3 and 4, the first guide 51 has a rectangular shape extending in a lateral direction X (also referred to as a width direction) perpendicular to the delivery direction B. The first guide 51 has a leading end 51*c* that is a long end extending from one end 51*a* to the other end 51*b* in the lateral direction X. The first guide 51 has a lateral end 51A mounted on an upper face 53*f* illustrated in FIGS. 5 and 6, which is an opposing face of the mount 53 opposing the intermediate transfer belt 31, so that the leading end 51*c* projects from a downstream end 53*c* of the mount 53 toward the secondary transfer nip N. The first guide 51 is attached to the upper face 53*f* by, e.g., a double-sided adhesive tape 57 so that, as illustrated in FIG. 3, the leading end Sic extending in the lateral direction X is perpendicular to the delivery direction B in plan view. Thus, the first guide 51 is disposed opposite the rollers 36 and 37.

As illustrated in FIGS. 3 and 4, the second guide 52 has a substantially rectangular shape extending in the lateral direction X perpendicular to the delivery direction B. The second guide 52 has a leading end 52*c* that is a long end extending from one end 52*a* to the other end 52*b* in the lateral direction X. The second guide 52 has a lateral end 52A mounted on a lower face 53*g* illustrated in FIGS. S and 6, which is an opposite face of the mount 53 disposed at a side opposite the upper face 53*f*, so that the leading end 52*c* projects from the downstream end 53*c* of the mount 53 toward the secondary transfer nip N. The lateral end 52A of the second guide 52 is attached to the lower face 53*g* of the mount 53. The second guide 52 is attached to the lower face 53*g* via, e.g., the double-sided adhesive tape 58 so that the leading end 52*c* extending in the lateral direction X is inclined from the end 52*a* to the other end 52*b* in the lateral direction X relative to the direction perpendicular to the delivery direction B. In other words, the second guide 52 is inclined from the end 52*a* to the other end 52*b* in an area AR having a projecting amount t3 of the leading end 51*c* beyond the downstream end 53*c* in FIG. 3, which is an opposing area in which the second guide 52 opposes the first guide 51. The leading end 52*c* of the second guide 52 is inclined so that a projecting amount t2 of the other end 52*b* beyond the downstream end (downstream face) 53*c* is greater than a projecting amount t1 of the end 52*a* beyond the downstream end 53*c*.

Figure 6:
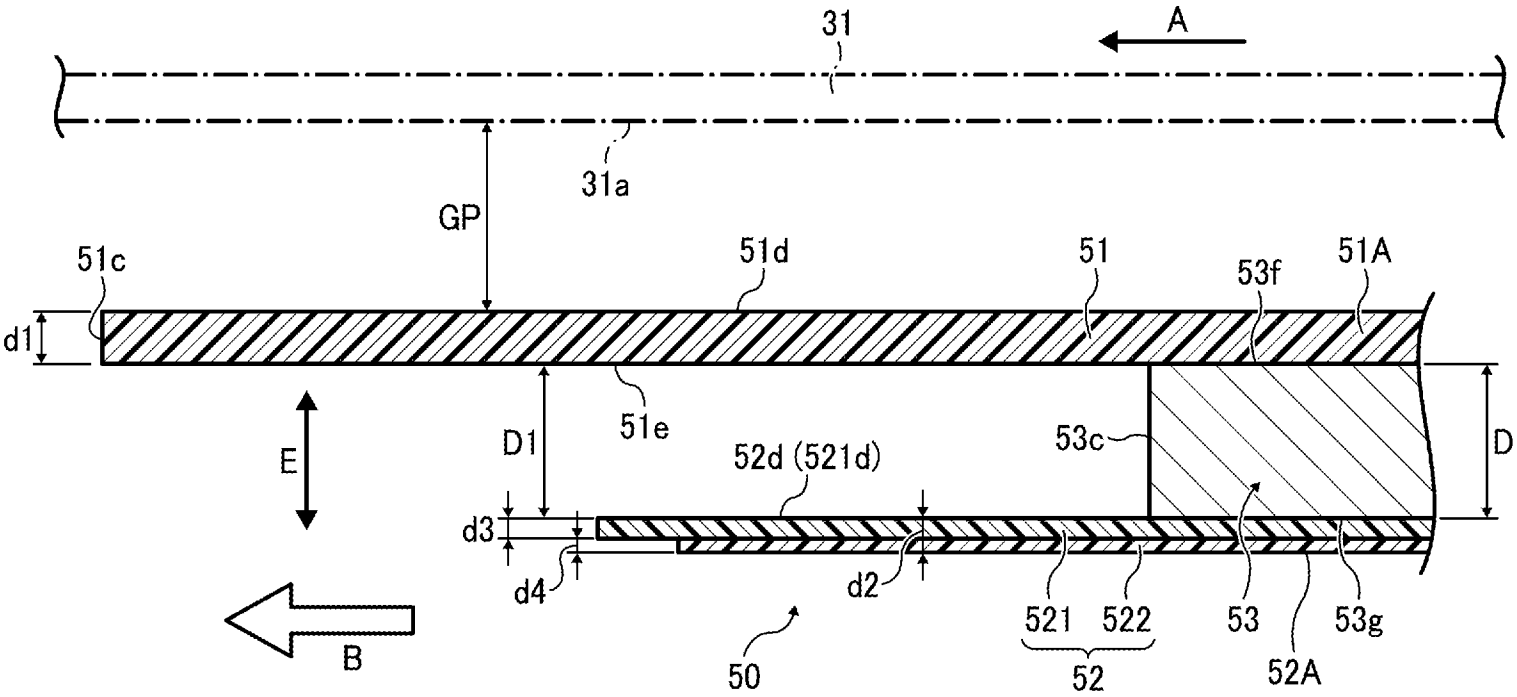
FIG. 6 is an enlarged cross-sectional view of the first guide and the second guide of FIG. 5.

As illustrated in FIG. 6, the first guide 51 and the second guide 52 are disposed opposing each other with a gap D1 in a direction thereinafter, adjoin-separation direction) indicated by arrow E in FIG. 6 to adjoin and separate from the front surface 31*a* of the intermediate transfer belt 31, that is, a direction in which each of the first guide 51 and the second guide 52 opposes the front surface 31*a* of the intermediate transfer belt 31. In other words, the mount 53 has a thickness D in the adjoin-separation direction E. The first guide 51 is attached to the upper face 53*f* of the mount 53, and the second guide 52 is attached to the lower face 53*g* of the mount 53. Accordingly, the first guide 51 and the second guide 52 are disposed on the mount 53 so that the first guide 51 and the second guide 52 oppose and separate from each other at a distance corresponding to the thickness D of the mount 53. The predetermined gap D1 used herein represents a gap between a back face 51*e* of the first guide 51 and an upper face 52*d* of the second guide 52 that are opposing faces of the first guide 51 and the second guide 52.

Figure 5:
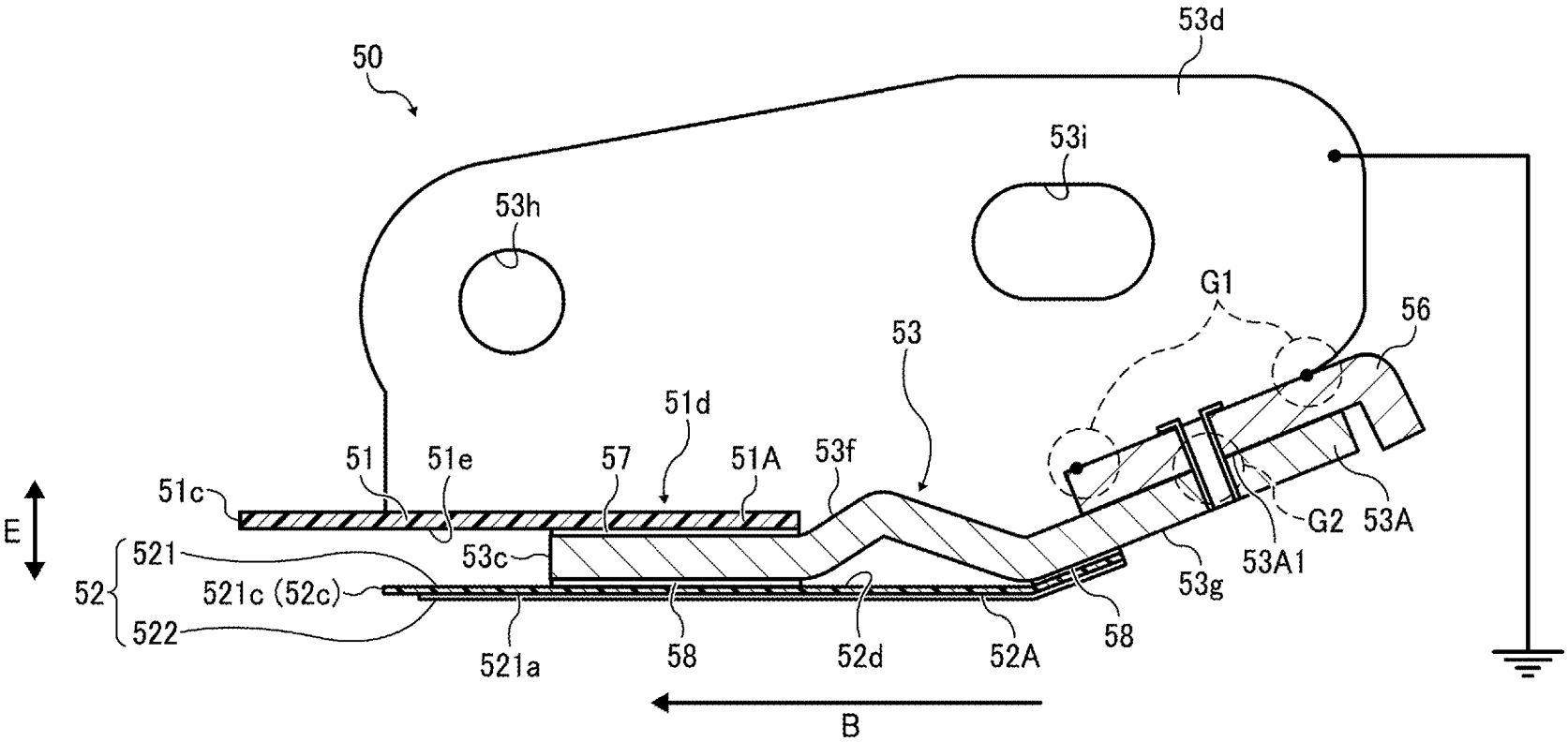
FIG. 5 is a cross-sectional view of the first guide and the second guide of FIG. 4.

In this embodiment, as illustrated in FIGS. 5 and 6, the second guide 52 includes a plurality of sheets 521 and 522 made of resin that are shifted from each other in the delivery direction B and laminated one on another in the adjoin-separation direction E. The sheet 521 is dimensioned so that a leading end 521*c* of the sheet 521 more projects from the downstream end 53*c* of the mount 53 than a leading end 522*c* of the sheet 522, and is attached to the lower face 53*g* of the mount 53. The sheet 522 is adhered to a lower face 521*a* of the sheet 521. In other words, for this embodiment, the projecting amounts t1 and t2 of the second guide 52 are of the sheet 521. The predetermined gap Di used herein represents a gap between the back face 51*e* of the first guide 51 and an upper face 521*d* of the sheet 521 that are opposing faces of the first guide 51 and the second guide 52 before deformation. The term "before deformation" means a state of the gap before the gap is deformed by the contact of the recording medium P against the second guide 52.

The first guide 51 and the second guide 52 are dimensioned to satisfy d1≥d2, where d1 is the thickness of the first guide 51 in the adjoin-separation direction F and d2 is the thickness of the second guide 52. The thickness d2 of the second guide 52 includes a thickness d3 of the sheet 521 and a thickness d4 of the sheet 522. Note that the relation of d1>d2 is preferable to allow the trailing end. Pb of the recording medium P to more smoothly move from the second guide 52 to the first guide 51.

The configuration of the multiple sheets 521 and 522 laminated facilitates adjustment of the thickness of the second guide 52. In other words, the first guide 51 presses the leading end Pa or the entire of the recording material P during passage, at a position upstream from the secondary transfer nip N in the delivery direction B. Accordingly, the first guide 51 has a hardness sufficient to prevent contact with the front surface 31*a* of the intermediate transfer belt 31 even when the first guide 51 is elastically deformed by contact with the recording medium P. By contrast, the second guide 52 has a flexibility, rather than a hardness, sufficient to elastically deform by contact with the trailing end Pb of the recording medium P. Accordingly, it may be more difficult to set the thickness d2 with a single sheet, Hence, in this embodiment, the multiple sheets are preferably laminated to obtain the desired thickness d2. Thus, the thickness d1 of the first guide 51 and the thickness d2 of the second guide 52 are set to satisfy the relation of d1≥d2. Note that the number of sheets constituting the second guide 52 is not limited to two and may be two or more. Alternatively, if proper elastic deformation is obtained, the second guide may be made of a single sheet.

Next, a description is given of a configuration of the mount 53. As illustrated in FIG. 3, the mount 53 has a rectangular shape extending in the lateral direction X, and is longer in the lateral direction X than each of the first guide 51 and the second guide 52. Opposed ends 53*a* and 53*b* of the mount 53 in the lateral direction X are bent upward in a side view perpendicular to the lateral direction X and provided with side mount faces 53*d* and 53*e*, respectively. The first guide 51 and the second guide 52 are mounted the mount 53 mounted on the mount 53 at the predetermined gap D1 away from each other. Such arrangement of the first guide 51 and the second guide 52 with the predetermined gap D1 secures a deformation area of the second guide 52. Accordingly, the thickness D of a portion of the mount 53 on which the lateral end 51A of the first guide 51 and the lateral end 52A of the second guide 52 are mounted is at least equal to the predetermined gap D1. The thickness D of the mount 53 is slightly different in size from the predetermined gap D1. This is because the first guide 51 and the second guide 52 are attached to the upper face 53*f* and the lower face 53*g* with the double-sided adhesive tape and the predetermined gap D1 includes the thickness D and the thickness of the double-sided adhesive tape. Note that the first guide 51 and the second guide 52 may be attached to the upper face 53*f* and the lower face 53*g* without using the double-sided adhesive tape 57. For example, in a configuration in which a liquid adhesive is employed, it is not necessary to consider the thickness of the double-sided adhesive tape 57, and the thickness D of the mount 53 equals to the predetermined gap D1.

As illustrated in FIGS. 4 and 5, each of the side mount faces 53*d* and 53*e* of the mount 53 includes holes 53*h* and 53*i*. By inserting, e.g., pins or shafts of, e.g., the side plates of the transfer unit 30 into the holes 53*h* and 53*i* of the mount 53, the guide unit 50 is supported with and fixed to the side plates. Accordingly, the guide unit 50 preferably has a desired hardness. However, considering the predetermined gap D1, the thickness D would be limited. hence, in this embodiment, a reinforcement 56 made of metal is joined to the mount 53 to partially increase the thickness of the mount 53. The reinforcement 56 has an L shape in cross section extending in the lateral direction X. The reinforcement 56 is disposed between the side mount faces 53*d* and 53*e* at a rear end 53A opposite a side of the mount 53 on which the first guide 51 and the second guide 52 are mounted. In this embodiment, as illustrated in FIG. 3, the reinforcement 56 is joined to the side mount faces 53*d* and 53*e*, and mounted on and joined to an upper face 53A1 of the rear end 53A. As illustrated in FIG. 3, a joined portion G1 between the reinforcement 56 and each of the side mount faces 53*d* and 53*e* is welded, and a joined portion 62 between the reinforcement 56 and the upper face 53A1 is caulked to form a single unit. The mount 53 is made of conductive metal, and is electrically grounded via a metal side plate 30A or a metal side plate 30B of the transfer unit 30 or a metal mount bracket 70 or a metal mount bracket 71, which are described below.

As described above, the formation of the mount 53 by joining multiple metal members preferably obtains a desired hardness while securing the predetermined gap D1 between the first guide 51 and the second guide 52. In addition, as illustrated in FIG. 6, the hardness stably maintains a clearance F between the front surface 31 a of the intermediate transfer belt 31 and the opposing face 51*d* of the first guide 51 opposing the front surface 31*a*.

Figure 7A:
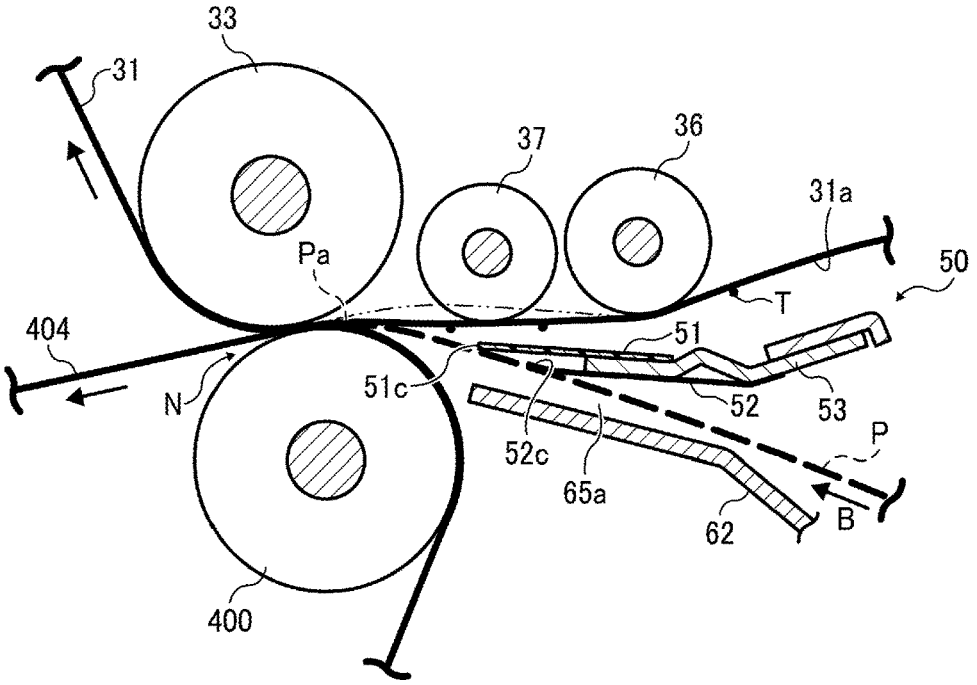
FIG. 7A is an enlarged view of a state in which a leading end of a strong recording medium has passed the first guide and the second guide.

Next, action of the guide unit 50 is described with reference to FIGS. 7A through 10B. FIGS. 7A, 7B, 8A, and 8B show states of passage of a thick sheet of paper serving as a strong recording medium P. FIGS. 9A, 9B, 10A, and 10B show states of passage of a thin sheet of paper serving as a weak recording medium P1, which has a lower basis weight than that of the thick sheet. As illustrated in FIG. 7A, the thick recording medium P is fed to the pre-nip delivery path 65*a* between the lower guide 62 and the guide unit 50. Depending on a delivery state, the leading end Pa of the thick recording medium P contacts the leading end 52*c* of the second guide 52, which is disposed more upstream in the delivery direction B, and the leading end 51*c* of the first guide 51 and passes the pre-nip delivery path 65*a*. The leading end Pa passes the guide unit 50 and contacts the front surface 31*a* of the intermediate transfer belt 31 between the roller 37 and the secondary transfer nip N. By the contact, the leading end Pa might push up the intermediate transfer belt 31 toward the inside of the belt loop and cause vibration of the intermediate transfer belt 31. In this embodiment, however, the roller 37 prevents the intermediate transfer belt 31 from being pushed up toward the inside of the loop of the intermediate transfer belt 31. The leading end 51*c* of the first guide 51 is disposed perpendicular to the delivery direction B in plan view. Accordingly, when the recording medium P passes below the leading end 51*c* of the first guide 51, the leading end 51*c* evenly contacts the recording medium P and is guided to the secondary transfer nip N, thus allowing stable entry of the leading end Pa of the recording medium P to the secondary transfer nip N.

As the leading end Pa of the recording medium P enters the secondary transfer nip N, the recording medium P more warps. However, the first guide 51 has a desired hardness, thus preventing the first guide 51 from being excessively bent toward the intermediate transfer belt 31. Accordingly, since the contact of the front surface 31*a* with the first guide 51 is prevented, the vibration of the intermediate transfer belt 31 is reduced, thus preventing occurrence of an abnormal image due to disturbance of a toner image borne on the front surface 31*a*.

Figure 7B:
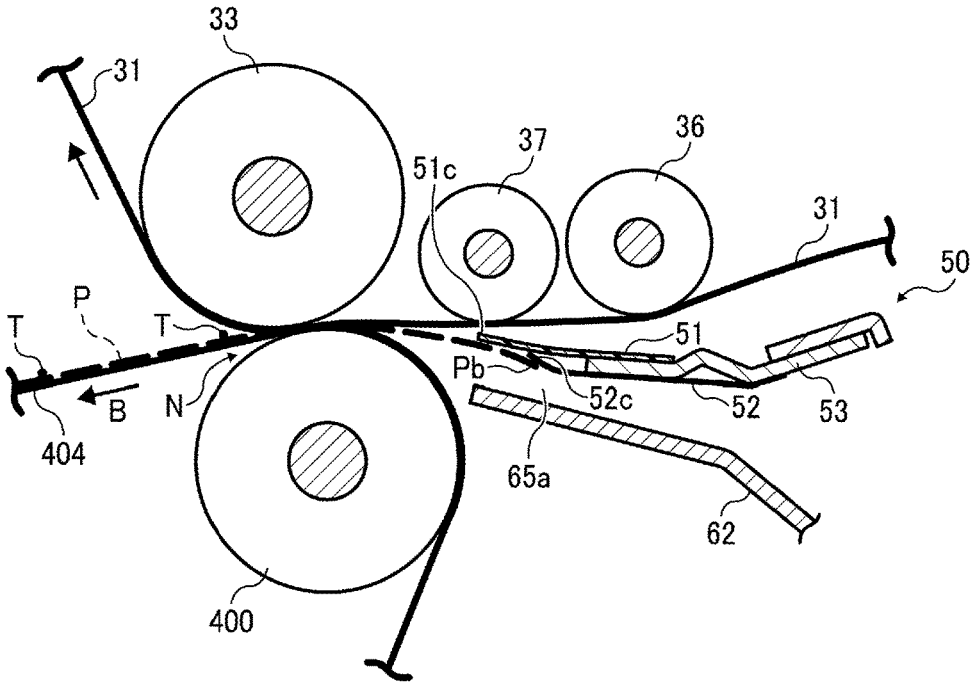
FIG. 7B is an enlarged view of a state in which a trailing end of the strong recording medium passes the second guide.

When the recording medium P is further delivered, the leading end Pa is guided into the secondary transfer nip N. The front surface 31*a* of the intermediate transfer belt 31 and the recording medium P tightly contact each other and enter the secondary transfer nip N. As illustrated in FIG. 7B, when the trailing end Pb of the recording medium P arrives at a lower portion of the guide unit 50, the trailing end Pb of the recording medium P moves while contacting the second guide 52. The second guide 52 is formed to be more easily bent, thus moderating the restoring action of the trailing end Pb of the recording medium P to return from the warping state into a flat state. Additionally, the second guide 52 is disposed away from the first guide 51, which is disposed above the second guide 52, at the predetermined gap D1 allowing deformation of the second guide 52. Accordingly, the second guide 52 can be sufficiently bent by the designed deformation amount, thus absorbing a restoration force of the trailing end Pb to return to the flat state.

Figure 8A:
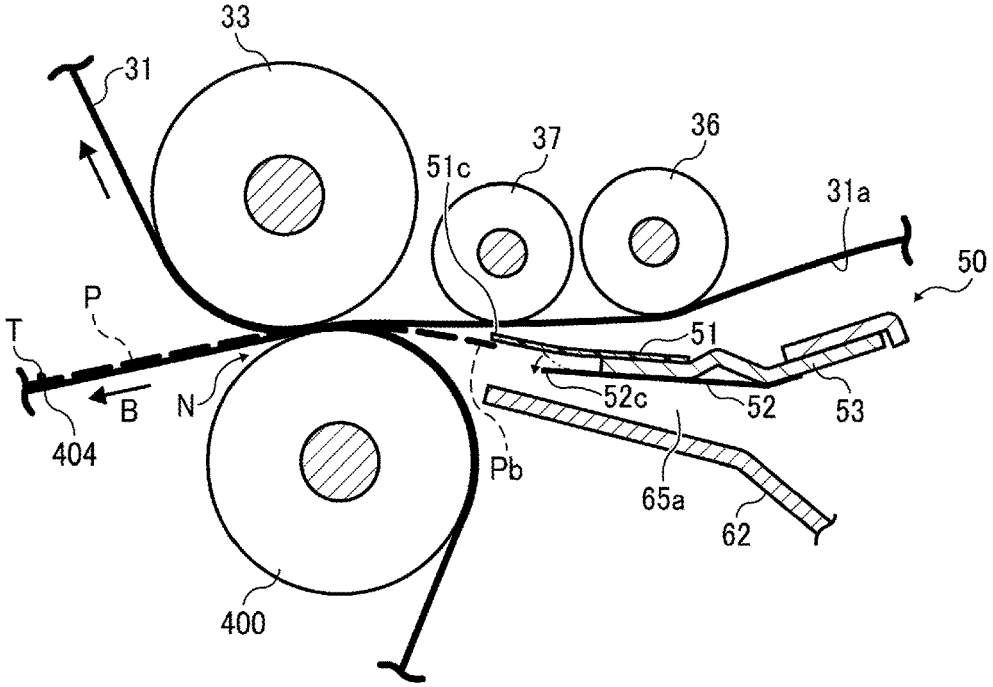
FIG. 8A is an enlarged view of a state in which the trailing end of the strong recording medium has moved from the second guide to the first guide.

The leading end 52*c* of the second guide 52 is disposed to be inclined relative to the delivery direction B in an area from the end 52*a* to the other end 52*b* in the lateral direction X. In other words, the leading end 52*c* of the second guide 52 is inclined so that a projecting amount t1 of the end 52*a* beyond the downstream end 53*c* is greater than a projecting amount t2 of the other end 52*b* beyond the downstream end 53*c*. Accordingly, as the recording medium P is delivered in the delivery direction B, the contact area of the second guide 52 with the recording medium P increases. Such a configuration moderates deformation of the second guide 52 toward the first guide 51. As illustrated in FIG. 8A, the trailing end Pb of the recording medium P smoothly moves to the first guide 51.

Figure 8B:
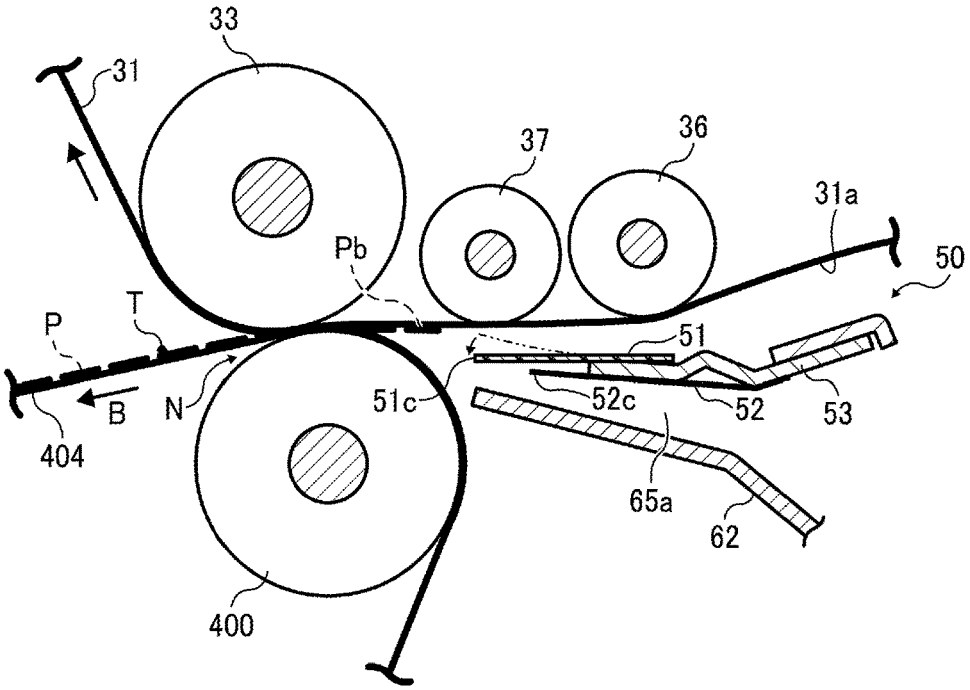
FIG. 8B is an enlarged view of a state in which the trailing end of the strong recording medium has passed the first guide.

The warping of the trailing end Pb of the recording medium P at the first guide 51 is reduced by deformation of the second guide 52 than when the trailing end Pb of the recording medium P arrives at the lower portion of the guide unit 50, thus moderating the restoring action. In such a state, when the recording medium P moves in the delivery direction B, the first guide 51 elastically deforms in a direction to approach the intermediate transfer belt 31. Accordingly, after the trailing end Pb passes below the first guide 51, as illustrated in FIG. 8B, the trailing end Pb moves away from the first guide 51 at a position relatively close to the front surface 31*a* of the intermediate transfer belt 31 and contacts the front surface 31*a*. Such a configuration allows the trailing end Pb of the recording medium P from contacting the front surface 31*a* after the flipping force of the trailing end Pb toward the front surface 31*a* is weakened, thus moderating the contact of the front surface 31*a* with the trailing end Pb of the recording medium P. In other words, the movement of the recording medium P from the second guide 52 to the front surface 31*a* of the intermediate transfer belt 31 is stepwisely and smoothly performed. Such a configuration moderates the contact of the trailing end Pb of the recording medium P having passed the first guide 51 with the front surface 31*a*, thus reliably preventing occurrence of an abnormal image on the recording medium P.

If the first guide 51 is heavily bent and contacts the front surface 31*a*, the roller 37 disposed inside the loop of the intermediate transfer belt 31 prevents the intermediate transfer belt 31 from being shifted toward the inside of the loop. Accordingly, vibration of the intermediate transfer belt 31 is reduced, thus more reliably preventing occurrence of an abnormal image on the recording medium P.

Figure 9A:
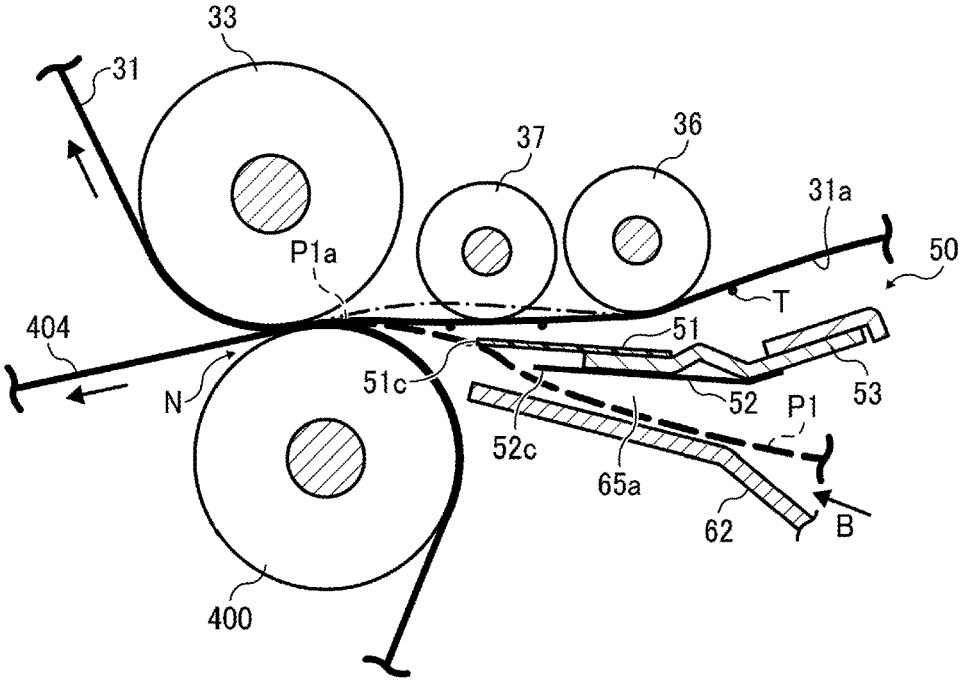
FIG. 9A is an enlarged view of a state in which a leading end of a weak recording medium has passed the first guide and the second guide.

As illustrated in FIG. 9A, the thin recording medium P1 of a lower basis weight is fed to the pre-nip delivery path 65*a* between the lower guide 62 and the guide unit 50. In such a case, depending on a delivery state, the leading end P1*a* of the thin recording medium P1 may pass the pre-nip delivery path 65*a* after contacting the leading end 51*c* of the first guide 51 without contacting the leading end 52*c* of the second guide 52, which is disposed more upstream in the delivery direction B. The leading end P1*a* passes the guide unit 50 and contacts the front surface 31*a* of the intermediate transfer belt 31 between the roller 37 and the secondary transfer nip N. By the contact, the leading end P1*a* might push up the intermediate transfer belt 31 toward the inside of the belt loop and cause vibration of the intermediate transfer belt 31. In this embodiment, however, the roller 37 prevents the intermediate transfer belt 31 from being pushed up toward the inside of the loop of the intermediate transfer belt 31. The leading end 51*c* of the first guide 51 is disposed perpendicular to the delivery direction B in plan view. Accordingly, when the recording medium P1 passes below the leading end 51*c* of the first guide 51, the leading end 51*c* evenly contacts the recording medium P1 and is guided to the secondary transfer nip N, thus allowing stable entry of the leading end P1*a* of the recording medium P1 to the secondary transfer nip N.

As the leading end P1*a* of the recording medium P1 enters the secondary transfer nip N, the recording medium P1 more warps. However, the first guide 51 has a desired hardness, thus preventing the first guide 51 from being excessively bent toward the intermediate transfer belt 31. Accordingly, since the contact of the front surface 31*a* with the first guide 51 is prevented, the vibration of the intermediate transfer belt 31 is reduced, thus preventing occurrence of an abnormal image due to disturbance of a toner image borne on the front surface 31*a*.

Figure 9B:
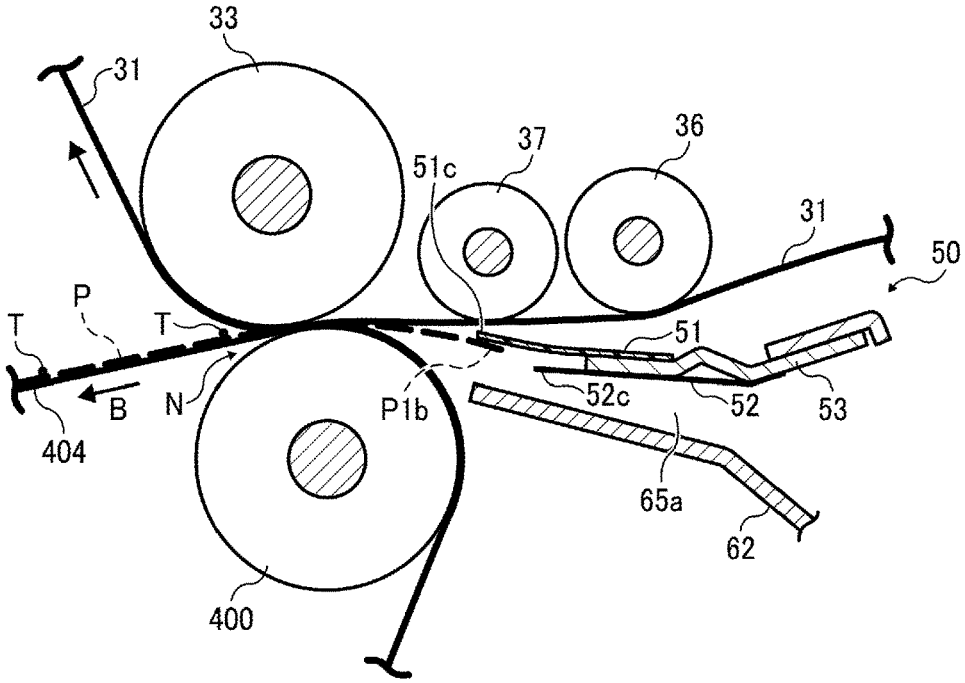
FIG. 9B is an enlarged view of a state in which a trailing end of the weak recording medium passes the second guide.

When the recording medium P is further delivered, the leading end Pa is guided into the secondary transfer nip N. The front surface 31*a* of the intermediate transfer belt 31 and the recording medium P tightly contact each other and enter the secondary transfer nip N. As illustrated in FIG. 9B, when the trailing end P1*b* of the recording medium P1 arrives at a lower portion of the guide unit 50, the trailing end P1*b* of the recording medium P1 moves while contacting the second guide 52. The second guide 52 is formed to be more easily bent, thus moderating the restoring action of the trailing end P1*b* of the recording medium P1 to return from the warping state into a flat state. Additionally, the second guide 52 is disposed away from the first guide 51, which is disposed above the second guide 52, at the predetermined gap D1 allowing deformation of the second guide 52. Accordingly, the second guide 52 can be sufficiently bent by the designed deformation amount, thus absorbing a restoration force of the trailing end P1*b* to return to the flat state.

Figure 10A:
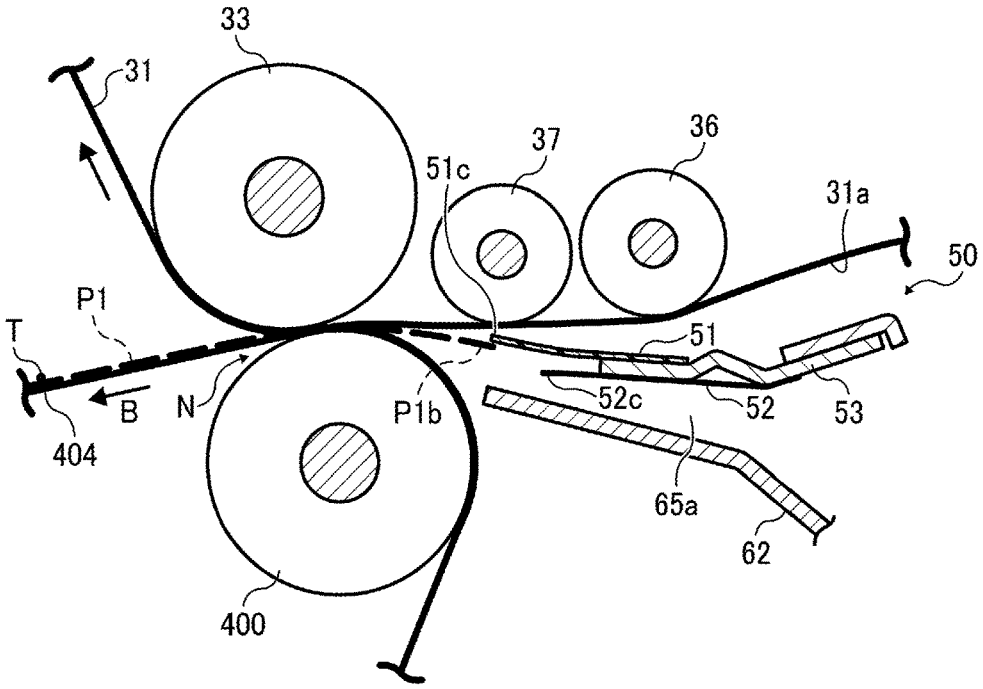
FIG. 10A is an enlarged view of a state in which the trailing end of the weak recording medium has moved from the second guide to the first guide.

The leading end 52*c* of the second guide 52 is disposed to be inclined relative to the delivery direction B in an area from the end 52*a* to the other end 52*b* in the lateral direction X. In other words, the leading end 52*c* of the second guide 52 is inclined so that a projecting amount t1 of the end 52*a* beyond the downstream end 53*c* is greater than a projecting amount t2 of the other end 52*b* beyond the downstream end 53*c*. Accordingly, as the recording medium P1 is delivered in the delivery direction B, the contact area of the second guide 52 with the recording medium P1 increases, thus moderating deformation of the second guide 52 toward the first guide 51. Thus, as illustrated in FIG. 10A, the trailing end P1*b* of the recording medium P1 smoothly moves to the first guide 51.

Figure 10B:
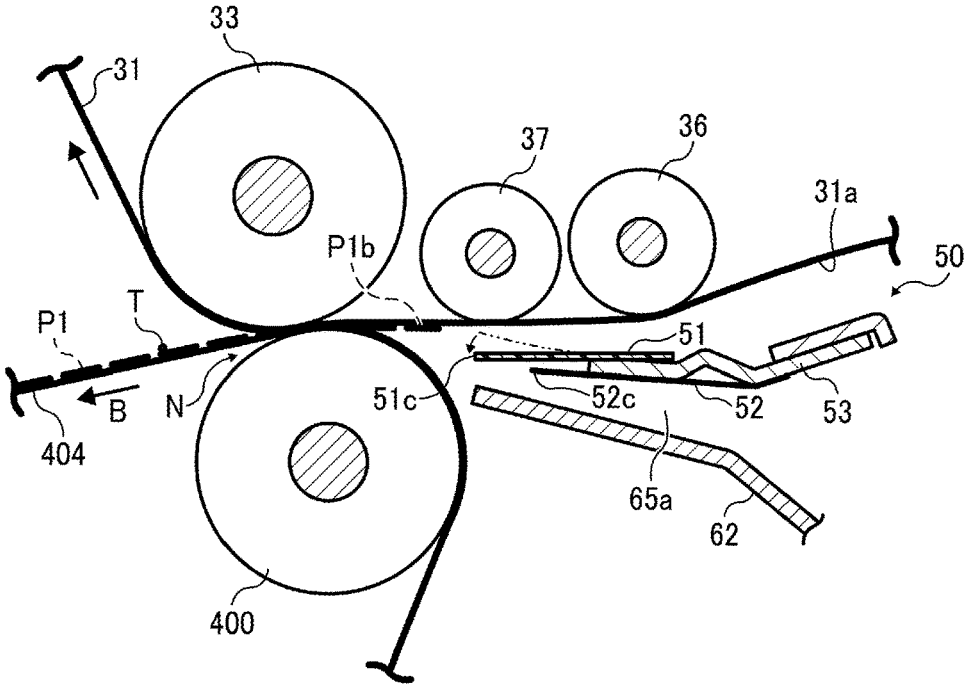
FIG. 10B is an enlarged view of a state in which the trailing end of the weak recording medium has passed the first guide.

The warping of the trailing end P lb of the recording medium P1 at the first guide 51 is reduced by deformation of the second guide 52 than when the trailing end Pb of the recording medium P arrives at the lower portion of the guide unit 50, thus moderating the restoring action. In such a state, when the recording medium P1 moves in the delivery direction B, the first guide 51 elastically deforms in a direction to approach the intermediate transfer belt 31. Accordingly, after the trailing end P1*b* passes below the first guide 51, as illustrated in FIG. 10B, the trailing end P1*b* moves away from the first guide 51 at a position relatively close to the front surface 31*a* of the intermediate transfer belt 31 and contacts the front surface 31*a*. Such a configuration allows the trailing end P1*b* of the recording medium P1 from contacting the front surface 31*a* after the flipping force of the trailing end P1*b* toward the front surface 31*a* is weakened, thus moderating the contact of the front surface 31*a* with the trailing end P1*b* of the recording medium P1. In other words, the movement of the recording medium P1 from the second guide 52 to the front surface 31*a* of the intermediate transfer belt 31 is stepwisely and smoothly performed. Such a configuration moderates the contact of the trailing end P1*b* of the recording medium P1 having passed the first guide 51 with the front surface 31*a*, thus reliably preventing occurrence of an abnormal image on the recording medium P1 The recording medium P1 is weaker and has a lower restoring force, Accordingly, the amount of deformation of the first guide 51 by the recording medium P1 is smaller than the recording medium P, and the contact of the trailing end P1*b* of the recording medium P1 having passed the first guide 51 with the front surface 31*a* is weaker than the contact of the trailing end Pb of the recording medium P. Such a configuration reliably prevents occurrence of an abnormal image on the recording medium P1.

Next, a description is given of the dimension of the guide unit 50 in this embodiment. In this embodiment, the gap GP of the opposing face 51*d* of the first guide 51 and the front surface 31*a* of the intermediate transfer belt 31 is disposed within a range of 0.5 mm to 2 mm from the front surface 31*a*. For the second guide 152, the projecting amount of the other end 52*b* beyond the end 52*a* is not greater than 5 mm. The predetermined gap D1 between the first guide 51 and the predetermined gap D1 is not greater than 2 mm. The thickness d1 of the first guide 51 is 0.35 mm in consideration of the hardness and the contact with the front surface 31*a* of the intermediate transfer belt 31. The thickness d1 can be greater. However, if the thickness d1 is greater, the first guide 51 would he closer to the front surface 31*a* and might contact the front surface 31*a*. Therefore, in consideration of the balance between the thickness and the gap GP, the thickness d1 is set to be 0.35 mm. The thickness d2 of the second guide 52 is not limited to 0.35 mm. However, if the thickness d2 is relatively smaller, the second guide 52 would have a relatively lower hardness and might be broken by contact with the recording medium P or P1. Accordingly, in consideration of endurance, the thickness d2 of the second guide 52 is set to be at least 0.125 mm. Such a thickness prevents breakage of the second guide 52 and causes the second guide 52 to be sufficiently bent, thus allowing smooth movement of the recording medium P from the second guide 52 to the first guide 51. The degree of bending and the contact state of each of the first guide 51 and the second guide 52 vary with the delivery speed of recording media R. Therefore, the above-described test of the thickness d2 of the second guide 52 is conducted with a maximum delivery speed of recording media in a test apparatus.

In delivery, typically, the strong recording medium P, a thick sheet of paper, contacts both the first guide 51 and the second guide 52, and the weak recording medium P1, a thin sheet of paper, contacts only the first guide 51 or the second guide 52. However, when the thin recording medium P1 is conveyed at a high speed, the thin recording medium P1 may contact both the first guide 51 and the second guide 52. Accordingly, recording media P to contact and be guided with the first guide 51 and the second guide 52 are not limited to thick sheets of paper and thin sheets of paper, and any suitable types of recording material to be delivered toward the secondary transfer nip N. In this embodiment, the first guide 51 and the second guide 52 are made of resin film(s). Note that, since the first guide 51 does not necessarily need bendability, the first guide 51 may be made of a single metal plate, instead of the resin film(s).

Next, a description is given of the configuration and arrangement of the rollers 36 and 37 serving as two rotators. As illustrated in FIG, 11, the rollers 36 and 37 are disposed side by side in a belt travel direction A of the intermediate transfer belt 31, at a position upstream from the secondary transfer nip N in the delivery direction B of the recording medium P (the belt travel direction A of the intermediate transfer belt 31) and opposing the guide unit 50. The rollers 36 and 37 contact the back surface 31*b* serving as the non image bearing face of the inter mediate transfer belt 31, which is disposed at an opposite side of the front surface 31*a*. The roller 37 is disposed closer to the secondary transfer nip N (the transfer section) than the roller 36. and serves as a first rotator. The roller 36 serves as a second rotator disposed upstream from the roller 37 in the belt travel direction A of the intermediate transfer belt 31. The roller 36 and the roller 37 are rotatably supported with mount brackets 70 and 71 opposing each other. The roller 36 is a metal roller, and the roller 37 adjacent to the secondary transfer nip N is an insulation roller to prevent leakage of secondary transfer bias. In this embodiment, the roller 37 is an insulation roller made of resin.

Figure 11:
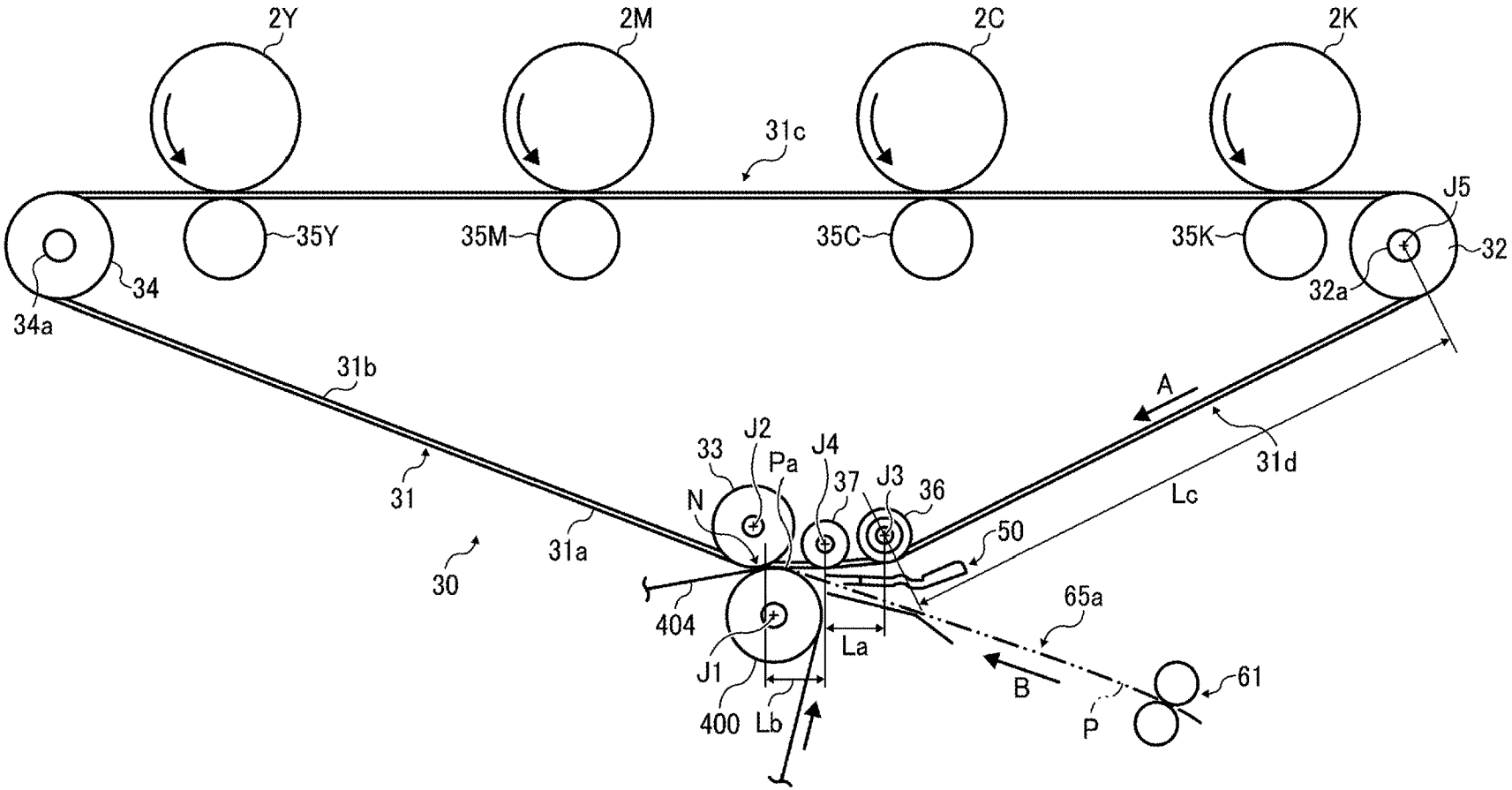
FIG. 11 is an illustration of the arrangement of two rotators serving as a plurality of contact members according to an embodiment of this disclosure.

The intermediate transfer belt 31 is supported with a plurality of rollers including, e.g., the drive roller 32, the secondary-transfer back surface roller 33, and the cleaning auxiliary roller 34. The drive roller 32 supports the intermediate transfer belt 31 at a most upstream position (a right-side position in FIG. 11) in the pre-nip delivery path 65*a* in the delivery. direction B of the recording medium P (a rightward direction in FIG. 11). Here, portions of the front surface 31*a* of the intermediate transfer belt 31 wound around and stretched between the plurality of rollers are defined as stretched surfaces. As a stretched surface, a transfer-entry-side stretched surface 31*d* is formed at a portion downstream from the drive roller 32 and upstream from the secondary transfer nip N in the belt travel direction A. As another stretched surface, an image-formation-side stretched surface 31*c* is formed at a portion upstream from the drive roller 32 in the belt travel direction A and opposing the photoconductors 2 (2Y, 2M, 2C, and 2K). The transfer-entry-side stretched surface 31*d* and the image-formation-side stretched surface 31*c* are formed by folding at the drive roller 32 (which is a roller disposed most upstream in the delivery direction B, that is, at the right side in FIG. 11). In a section of the transfer-entry-side stretched surface 31*d*, the intermediate transfer belt 31 moves toward the same direction as the delivery direction B in the pre-nip delivery path 65*a* (the right side to the left side in FIG. 11). In a section of the image-formation-side stretched surface 31*c*, the intermediate transfer belt 31 moves toward a direction opposite the delivery direction B in the pre-nip delivery path 65*a*.

The rollers 36 and 37 contact the back surface 31*b* of the intermediate transfer belt 31 at the transfer-entry-side stretched surface 31*d*. The intermediate transfer belt 31 wind around each of the rollers 36 and 37 at a certain amount. Each of the rollers 36 and 37 is disposed at a position upstream in the belt travel direction A from a position at which a leading end Pa of a recording medium P delivered from the pair of registration rollers 61 toward the secondary transfer nip N contacts the front surface 31*a* of the intermediate transfer belt 31. Each of the rollers 36 and 37 is disposed at a position closer to the secondary transfer nip N than the drive roller 32 in the transfer-entry-side stretched surface 31*d*, In other words, an interaxial distance La between the roller 36 disposed at the upstream side (hereinafter, also referred to as the upstream roller 36) and the roller 37 disposed at the downstream side (hereinafter, also referred to as the downstream roller 37) in the belt travel direction A is shorter than a distance Lc from the drive roller 32 to the upstream roller 36. A distance Lb from the downstream roller 37 to the secondary transfer nip N is shorter than the distance Lc from the drive roller 32 to the upstream roller 36. A total distance of La and Lb is set to be shorter than the distance Lc.

In other words, the front surface 31*a* of the intermediate transfer belt 31 is wound around the drive roller 32 that serves as an adjustment rotator disposed upstream from the transfer nip N in the belt travel direction A (a rotation travel direction of the intermediate transfer belt 31) to adjust the orientation of the intermediate transfer belt 31. Accordingly; the front surface 31*a* of the intermediate transfer belt 31 is divided into the image-formation-side stretched surface 31*c* upstream from the drive roller 32 in the belt travel direction A and the transfer-entry-side stretched surface 31*d* between the drive roller 32 and the secondary transfer nip N, La represents a distance (inter-rotational-center distance) between a rotation center J3 of the roller 36 and a rotation center J4 of the roller 37. Lb is a distance from the rotation center J4 of the roller 37 serving as the first rotator disposed closer to the secondary transfer nip N, of the rollers 36 and 37, and the secondary transfer nip N. Lc is a distance from the rotation center J3 of the roller 36 serving as the second rotator disposed further away from the secondary transfer nip N than the roller 37, of the rollers 36 and 37, and the rotation center J5 of the drive roller 32. The rollers 36 and 37 and the drive roller 32 are disposed to satisfy the relations of La<Lc, Lb<Le, and La+Lb<Lc.

As described above, as compared with a configuration in which only the roller 36 is disposed at the transfer-entry-side stretched surface 31*d*, the arrangement of the rollers 36 and 37 on the transfer-entry-side stretched surface 31*d* reduces the shift (referred to as shock jitter) of the transfer position of a toner image at the primary transfer section, which is formed at an opposing portion at which the photoconductors oppose the front surface 31*a* of the intermediate transfer belt 31, due to transmission of an impact (shock) of a contact of the recording medium P with the front surface 31*a* of the intermediate transfer belt 31 to the image-formation-side stretched surface 31*c*. The arrangement of the rollers 36 and 37 at a position closer to the secondary transfer nip N than the drive roller 32 reliably reduces flutter or vibration of the intermediate transfer belt 31 due to a contact of a leading end Pa or a trailing edge Pb of a recording medium P with the intermediate transfer belt 31.

Figure 12:
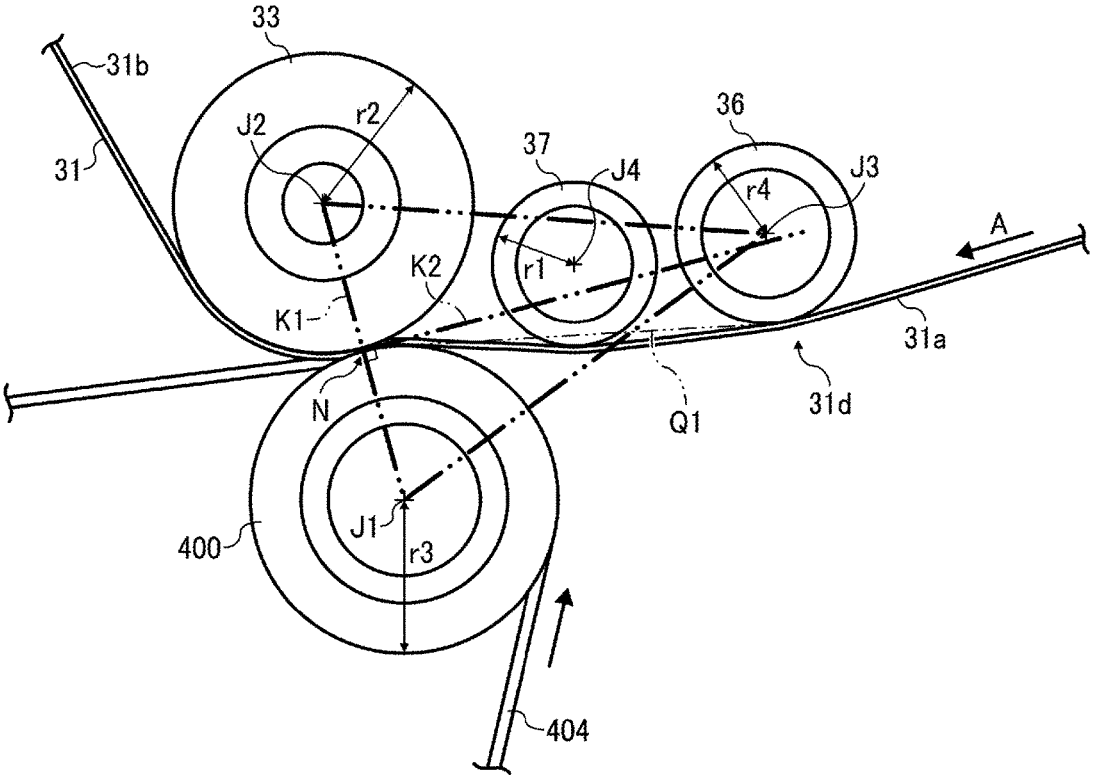
FIG. 12 is an enlarged view of the two rotators of FIG. 11.

As illustrated in FIG. 12, an imaginary line K1 is defined as a line connecting a rotation center 12 of the nip forming roller (also referred to as the secondary transfer roller) 400 forming the secondary transfer nip N and a rotation center J1 of the secondary transfer back surface roller (secondary transfer opposing roller) 33 serving as a rotator. A normal line K2 is defined as a line perpendicular to the imaginary line K1 and passing the center of the secondary transfer nip N (a center NP1 in the belt travel direction A). In this embodiment, the rollers 36 and 37 are disposed projecting beyond the normal line K2 toward the front surface 31*a* of the intermediate transfer belt 31 (downward in FIG. 12). In other words, the contact positions of the rollers 36 and 37 with the intermediate transfer belt 31 are disposed at the side of the front surface 31*a* serving as the image bearing surface relative to the normal line K2.

At a position upstream from the secondary transfer nip N, the intermediate transfer belt 31 is wound around the secondary transfer belt 404 by the downstream roller 37. An imaginary surface Q1 is defined as a stretched surface of the intermediate transfer belt 31 between the secondary transfer nip N and the upstream roller 36, assuming that the downstream roller 37 is not provided. In the area of the imaginary surface Q1, the intermediate transfer belt 31 is wound around the secondary transfer belt 404 by the upstream roller 36, at a position upstream from the secondary transfer nip N.

Such arrangement of the rollers 36 and 37 allows the rollers (in particular, the roller 36 at the upstream side in the belt travel direction A) to apply tension to the intermediate transfer belt 31, thus reducing the fluttering or vibration of the intermediate transfer belt 31 and allowing more stable rotation of the intermediate transfer belt 31.

In this embodiment, a triangle is defined by the rotation center J1 of the nip forming roller 400, the rotation center J2 of the secondary-transfer back surface roller 33, and the rotation center J3 of the upstream roller 36. At this time, the downstream roller 37 is disposed such that the rotation center J4 is located within a range of the triangle (within the triangle). Such arrangement prevents the downstream roller 37 from excessively projecting toward the front surface 31*a* of the intermediate transfer belt 31 (downward in FIG. 12). By regulating the projecting amount of the roller 37 at the downstream side as described above, when the recording medium P contacts the front surface 31*a* at a position upstream from the secondary transfer nip N, the intermediate transfer belt 31 is bent to an extent that the delivery of the recording medium P is not disturbed. Such a configuration allows stable delivery of the recording medium P to the secondary transfer nip N while reducing the shock jitter. Such regulation of the projecting amount also prevents excessive decrease of the gap GP between the front surface 31*a* and the opposing face 51*d* of the first guide 51 of the guide unit 50 (see FIG. 6), thus facilitating the setting of the gap GP. The radius r1 of the downstream roller 37 is smaller than each of the radius r2 of the nip forming roller (secondary transfer roller) 400, the radius r3 of the secondary-transfer back surface roller 33, and the radius r4 of the upstream roller 36. Such a configuration allows the secondary-transfer back surface roller 33, the upstream roller 36, and the downstream roller 37 to be disposed adjacent to each other in the pre-nip delivery path 65*a*.

When the recording material P is a thick sheet of paper, the bending amount of the first guide 51 or the second guide 52 of the guide unit 50 is relatively large, the distance (the gap GP) between the guide unit 50 and the front surface 31*a* of the intermediate transfer belt 31, more preferably, the first guide 51 and the front surface 31*a* is preferably larger. However, if the distance (the gap GP) between the front surface 31*a* and the first guide 51 is increased, as described above, a trailing end Pb of the recording medium P would more strongly flip up after passage of the first guide 51 and cause vibration in the intermediate transfer belt 31, thus resulting in a reduction in image quality. Therefore, in the case of the thick sheet of paper, the roller 37 is pushed further downward than in the case of a thin sheet of paper, to reduce the distance (the gap GP). In other words, the projection amount of the roller 37 is greater in the case of the thick sheet of paper than in the case of the thin sheet of paper.

Figure 13:
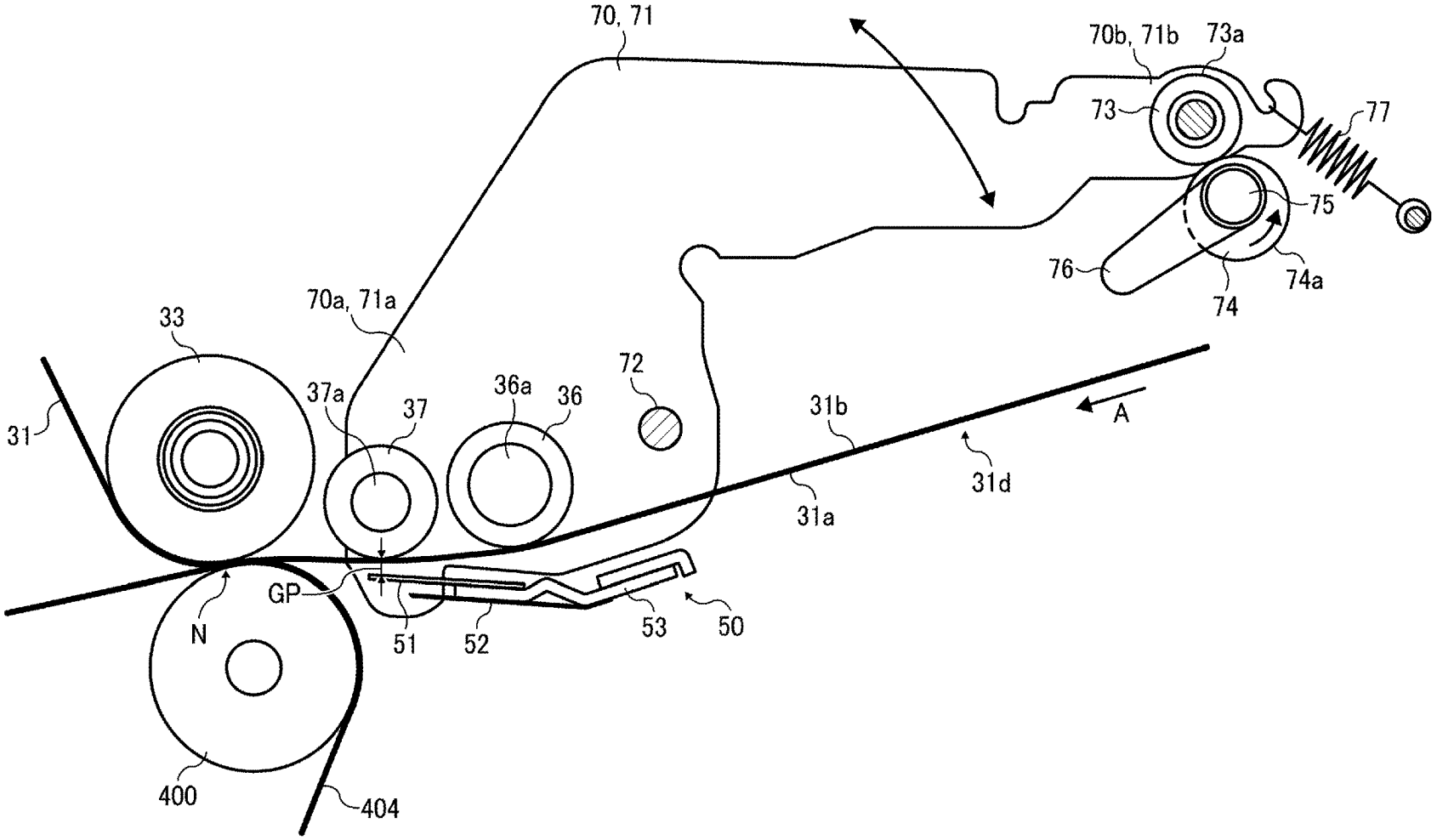
FIG. 13 is an illustration of a configuration in which the two rotators are manually movable and a reference position.
Figure 14:
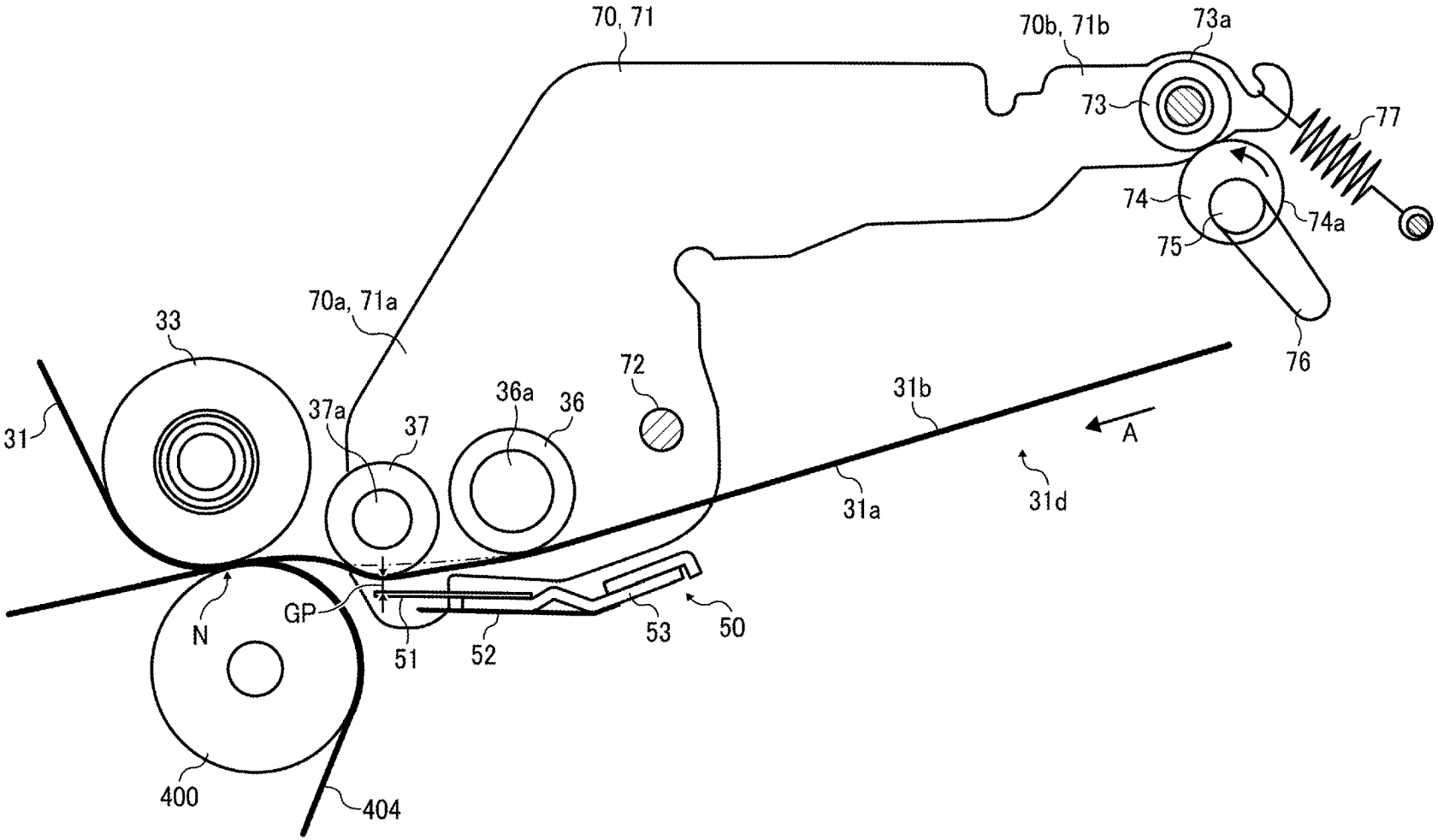
FIG. 14 is an illustration of a configuration in which the two rotators are manually movable and a projection position.
Figure 15:
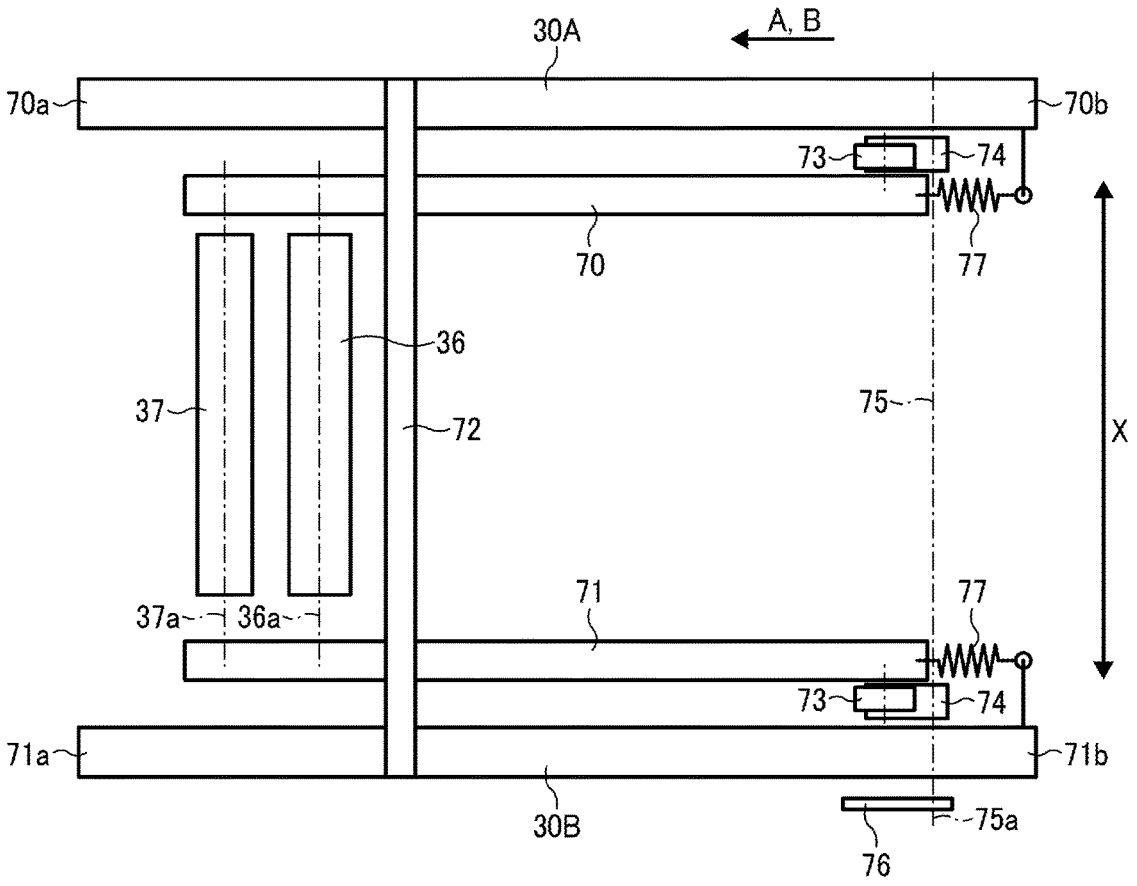
FIG. 15 is a plan view of a support structure of the two rotators.

Hence, in this embodiment, as illustrated in FIGS. 13 and 14, the downstream roller 37 can move the first conveyor (31) toward the guide unit 50. For example, the mount brackets 70 and 71 rotatably supporting the roller 36 and the roller 37 are swingable in a direction E in which at least the roller 37 approaches or separates from the guide unit 50. In this embodiment, as illustrated in FIG. 15, a pair of the mount brackets 70 and 71 are swingably supported around a shaft 72 on the metal side plates 30A and 30B of the transfer unit 30, which oppose each other. The mount brackets 70 and 71 have basically the same shape and rotatably support the rollers 36 and 37 with shafts 36*a* and 37*a*, respectively, at one end 70*a* and one end 71*a*. Circular rollers 73 rotatably supported are disposed at the other end 70*b* and the other end 71*b* opposite the one end 70*a* and the one end 71*a* across a swing fulcrum supported with the shaft 72, Outer circumferential faces 73*a* of the circular rollers 73 contact respective cam faces 74*a* at outer circumferences of eccentric cams 74. Each of the eccentric cams 74 extends in the lateral direction X and is mounted on a rotation shaft 75 rotatably supported at the side plates 30A and 30B. A lever 76 to rotate each eccentric cam 74 is fixed at one end 75*a* of the rotation shaft 75. Coil springs 77 bias the mount brackets 70 and 71 in a direction so that the outer circumferential face 73*a* of each circular roller 73 presses the cam face 74*a* of the eccentric cam 74.

In this embodiment, when the mount brackets 70 and 71 swing counterclockwise around the shaft 72, the roller 37 moves in a direction to approach the guide unit 50. By contrast, when the mount brackets 70 and 71 swing clockwise around the shaft 72, the roller 37 moves in a direction to separate from the guide unit 50. FIG. 13 shows a state in which the roller 37 is placed at a reference position. FIG. 14 shows a state in which the mount brackets 70 and 71 swing counterclockwise and the roller 37 is placed at a projecting position at which the projecting amount of the roller 37 is greater than that at the reference position. The reference position used herein represents a position selected when a recording medium P is from a plain sheet of paper to a thin sheet of paper. The projecting position used herein represents a position selected when a recording medium P is a thick sheet of paper. For example, when the recording medium P is from a plain sheet of paper to a thin sheet of paper, the roller 37 is moved with the lever 76 to the reference position illustrated in FIG. 13. When the recording medium P is a thick sheet of paper. the roller 37 is moved with the lever 76 to the projecting position illustrated in FIG. 14. In other words, in this embodiment, the angle of the recording medium P fed to the intermediate transfer belt 31 and the secondary transfer nip N is adjusted by changing the position of the roller 37 in accordance with the condition of the recording medium P.

Figure 16:
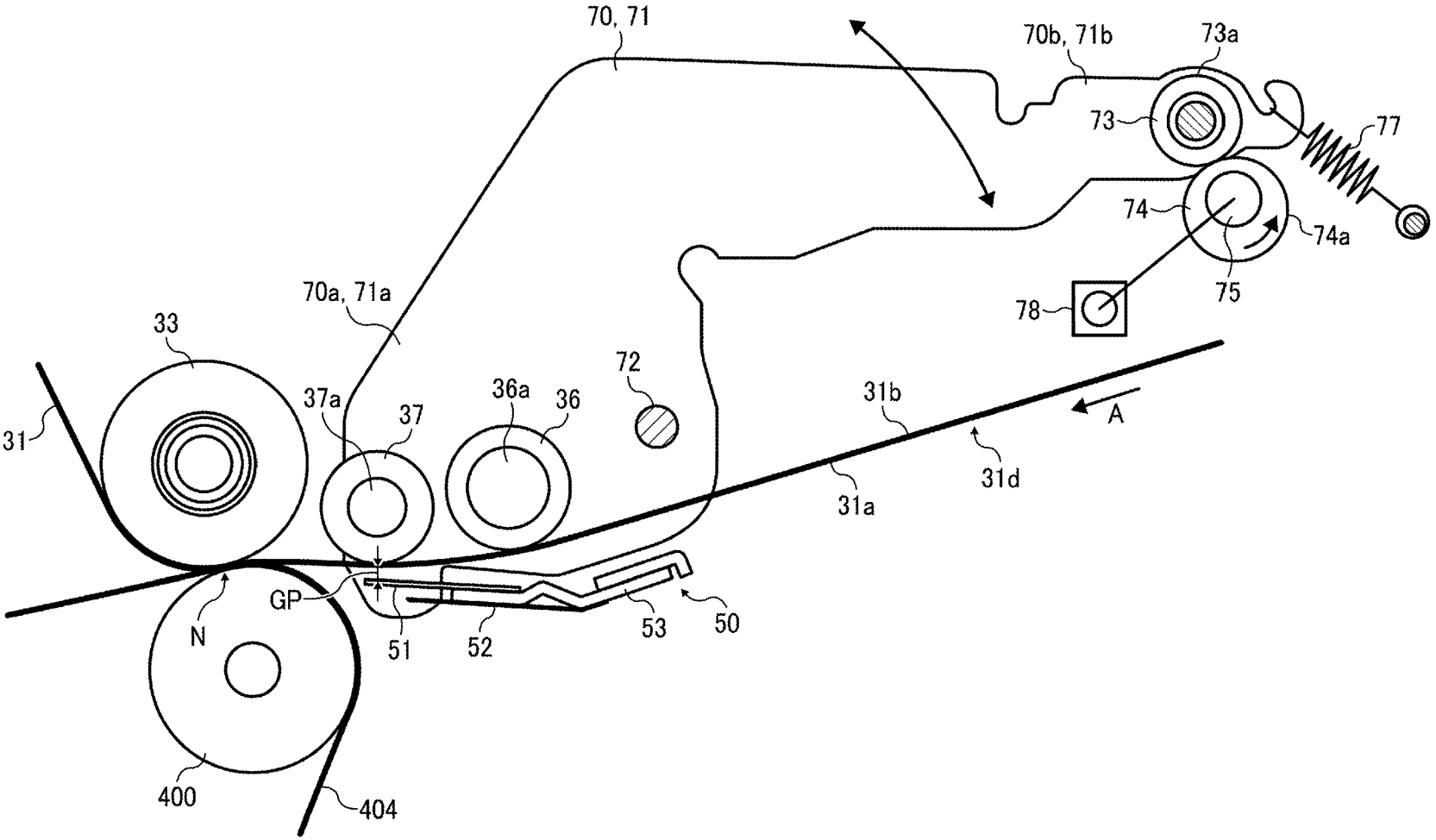
FIG. 16 is an illustration of a configuration in which the two rotators are electrically movable and a reference position.
Figure 17:
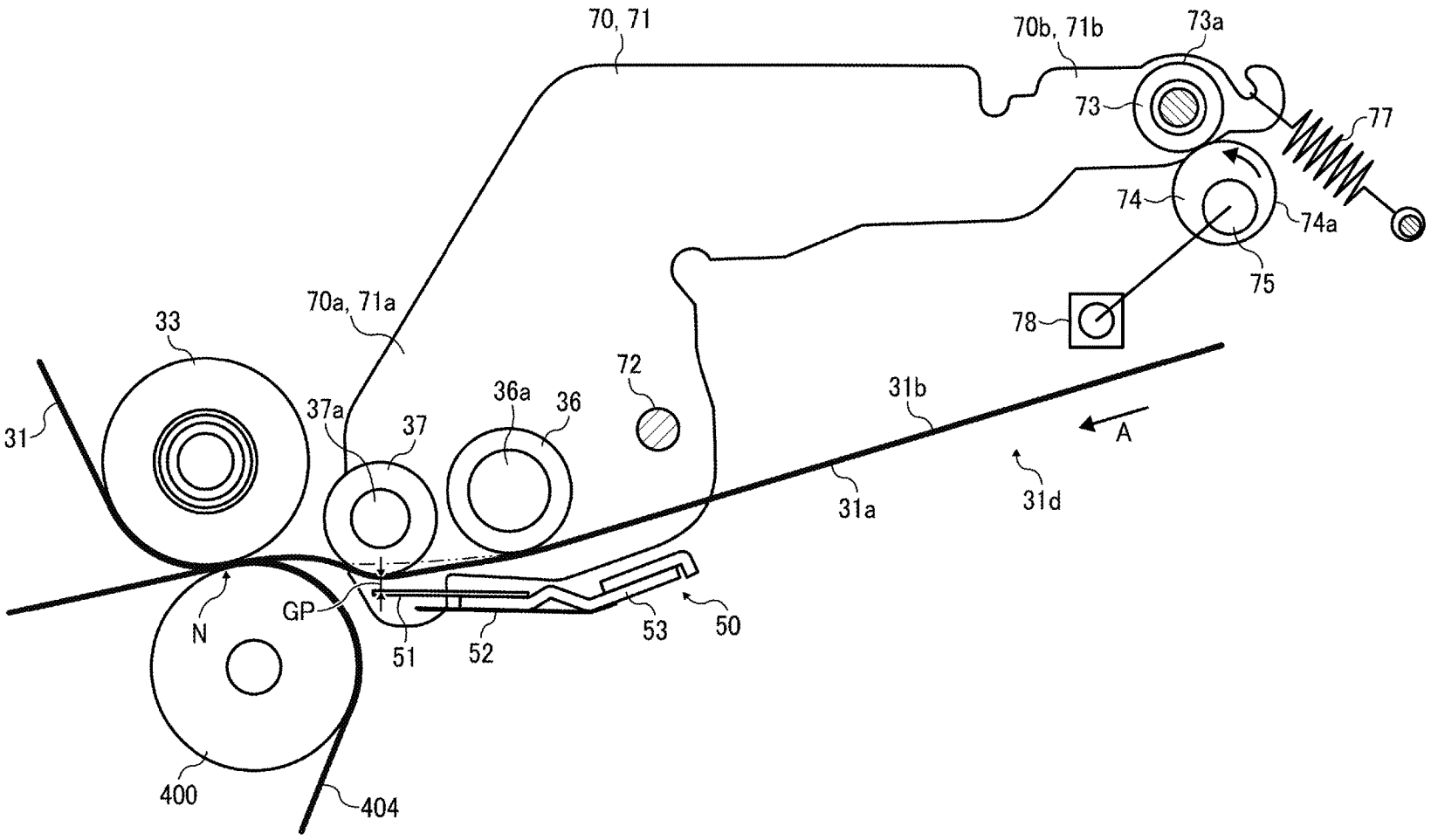
FIG. 17 is an illustration of a configuration in which the two rotators are electrically movable and a projection position.

As described above, the position of the roller 37 is movable to a position at which the intermediate transfer belt 31 is placed adjacent to the guide unit 50 and to a position at which the intermediate transfer belt 31 is placed away from the guide unit 50, thus allowing adjustment of the projecting amount of the roller 37 in accordance with the thickness of the recording medium P. In other words, the distance (the gap GP) between the guide unit 50 and the front surface 31*a* is adjustable, and the position of the front surface 31*a* of the intermediate transfer belt 31 is adjustable to an optimal position suitable for the recording medium P. Such a configuration reduces vibration of the intermediate transfer belt 31, thus preventing a reducing in image quality. In FIGS. 13, 14, and 15, the swing operation of the mount brackets 70 and 71 is manually performed with the lever 76. However, the position adjustment of the roller 37 is not limited to such a configuration. For example, as illustrated in FIGS. 16 and 17, instead of the lever 76, a drive motor 78 rotates the rotation shaft 75 to electrically adjust the position of the roller 37.

Figure 18:
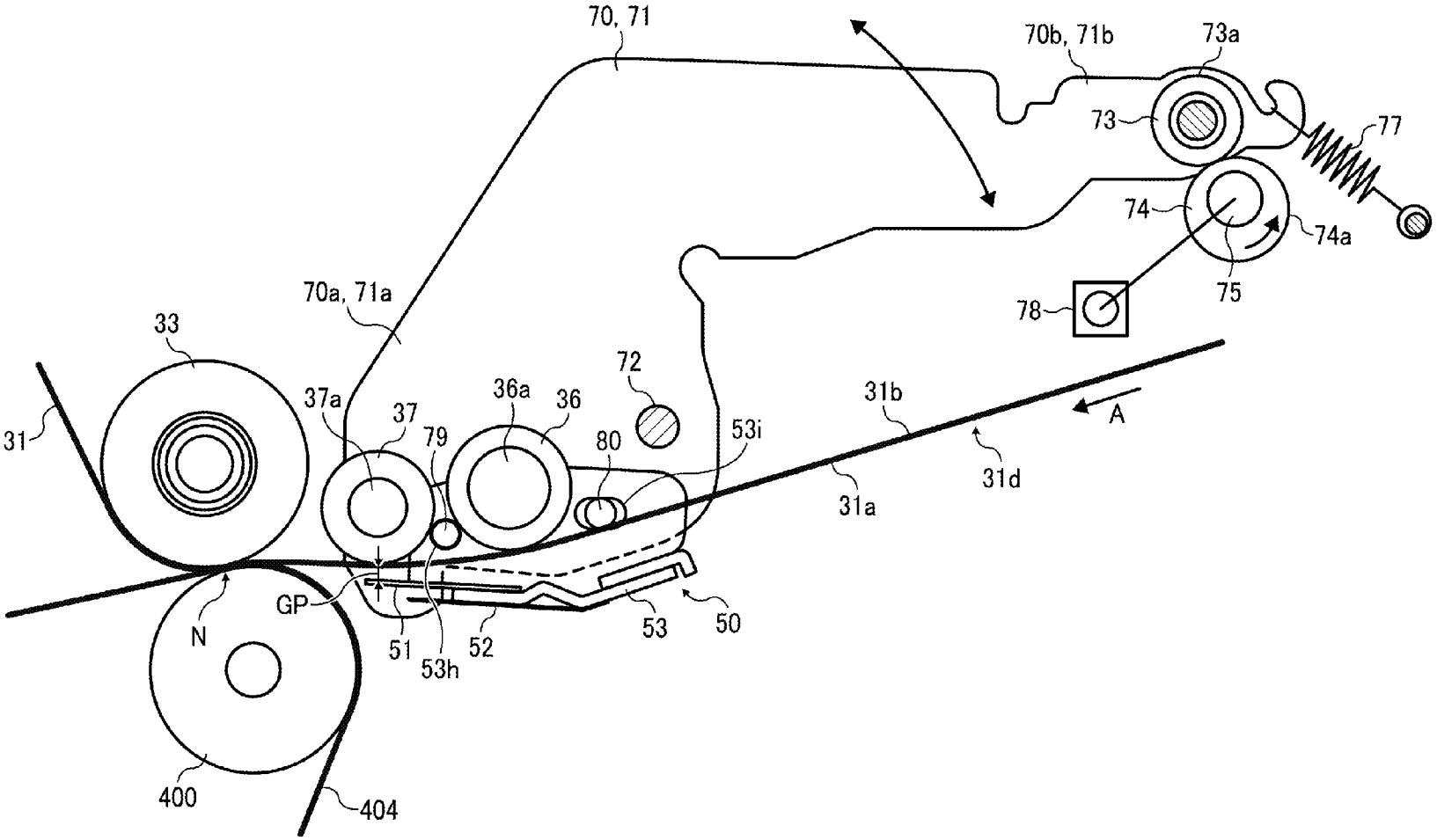
FIG. 18 is an illustration of a configuration in which the two rotators and a guide unit are electrically movable and a reference position.
Figure 19:
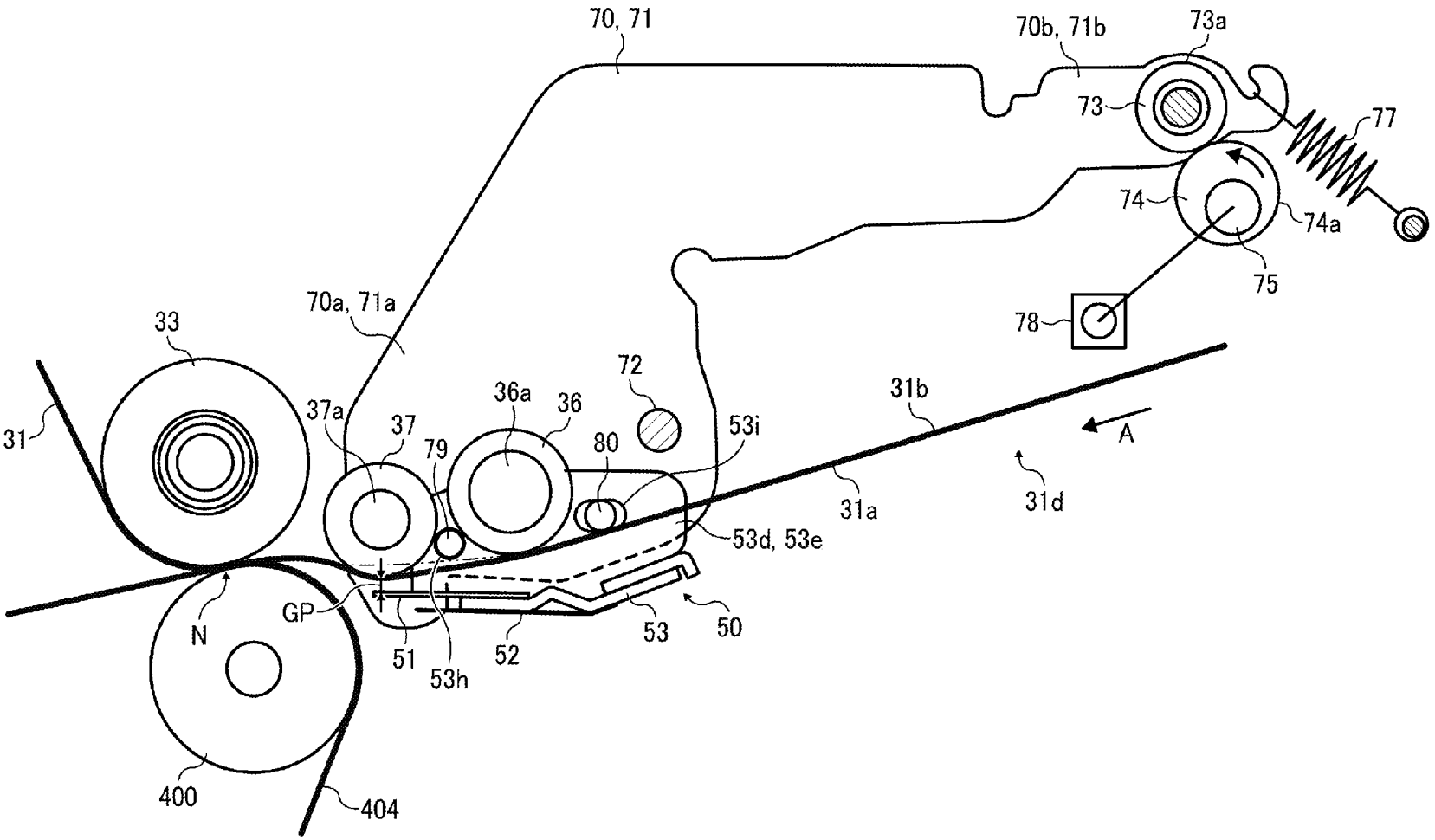
FIG. 19 is an illustration of a configuration in which the two rotators and a guide unit are electrically movable and a reference position.

In the above-described embodiment, the roller 37 is supported to be swingable relative to the guide unit 50 to adjust the distance (the gap GP) between the front surface 31*a* of the intermediate transfer belt 31 and the guide unit 50 (the opposing face 51*d* of the first guide 51). In an embodiment illustrated in FIGS. 18 and 19, the guide unit 50 is mounted and fixed to the mount brackets 70 and 71, and the roller 37 and the guide unit 50 are movable together as a single unit. When only the roller 37 is moved, the distance (the gap GP) is adjustable to the thickness of the recording medium P. However, depending on the stage of the recording medium P, it may be preferable to change the projecting amount of the intermediate transfer belt 31 with the distance (the gap GP) constant. Hence, pins 79 and 80 to insert into and support holes 53*h* and 53*i* of side mount faces 53*d* and 53*e* are disposed at each of the one end 70*a* and the one end 71*a* of the mount brackets 70 and 71. In this embodiment, the pins 79 and 80 are inserted into the holes 53*h* and 53*i* for fixation, thus allowing the roller 37 and the guide unit 50 to move together as a single unit. With such a configuration, the roller 37 and the guide unit 50 are fixed to common supports, that is, the mount brackets 70 and 71. Accordingly, variances in assembly are reduced, thus maintaining the gap GP at a stable distance. In addition, since the position of the roller 37 is adjustable in accordance with the recording medium P, the tension to the intermediate transfer belt 31 is adjustable, thus reducing vibration of the intermediate transfer belt 31 before entry to the secondary transfer nip N. In this embodiment, the position of the roller 37 is changed in accordance with the thickness of the recording medium P. Alternatively, in some embodiments, the position of the roller 37 may be changed in accordance with the bending stiffness.

Figure 21:
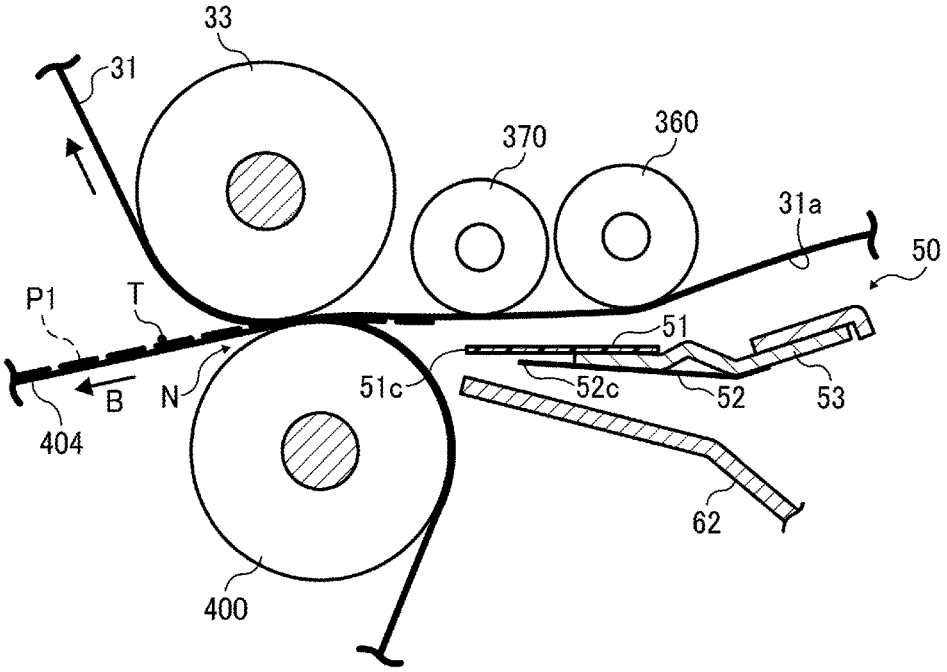
FIG. 21 is an enlarged view of a plurality of contact members according to another embodiment of this disclosure.
Figure 22:
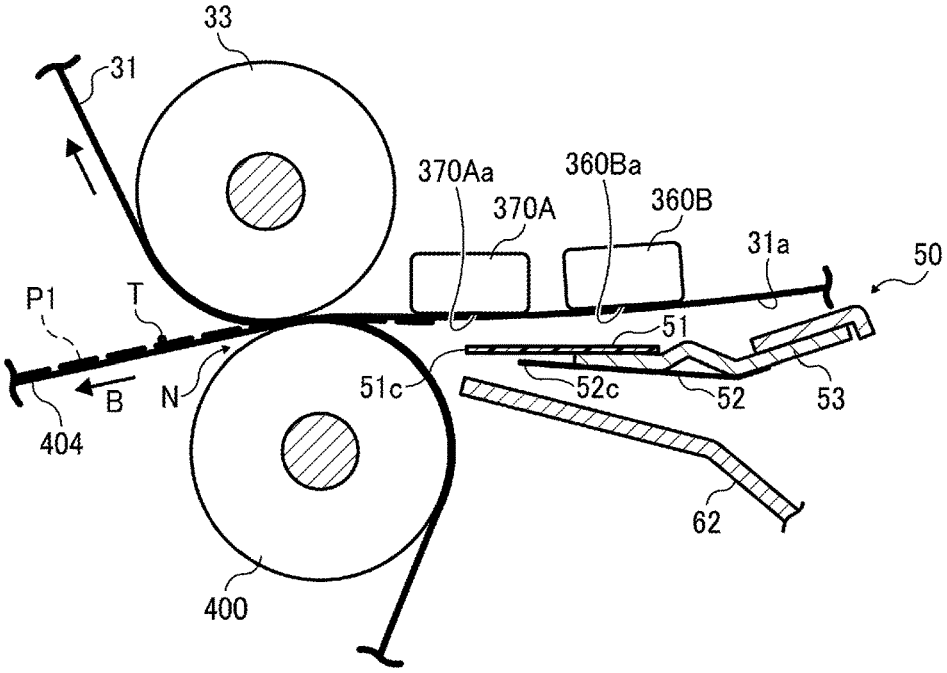
FIG. 22 is an enlarged view of a plurality of contact members according to still another embodiment of this disclosure.

In the above-described embodiment, the multiple rollers 36 and 37 serving as a plurality of rotators and a plurality of contact members are rotatably supported with the mount brackets 70 and 71. However, in some embodiments, as illustrated in FIG. 21, one or both of a plurality of contact members 360 and 370 are nonrotatable (stationary) rollers that do not rotate with movement of the intermediate transfer belt 31 serving as the image bearer. Alternatively, at least one of the roller 36 and the roller 37 in the above-described embodiment may be a nonrotatable (stationary) roller.

Figure 23:
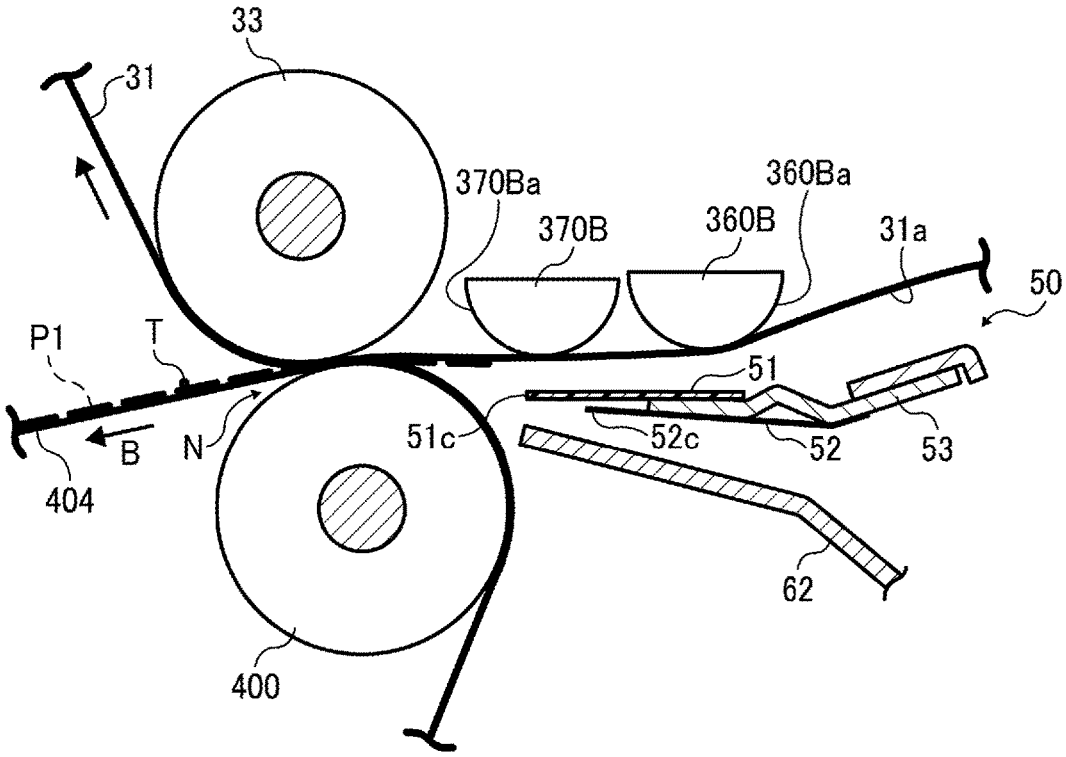
FIG. 23 is an enlarged view of a plurality of contact members according to yet still another embodiment of this disclosure.

The plurality of contact members are not limited to the configurations of the rollers 36 and 37 or the contact members 360 and 370 and may be any other suitable type of members. For example, as illustrated in FIG, 22, as the plurality of contact members, a first contact member 370A and a second contact member 360A of a block shape are disposed opposing the intermediate transfer belt 31. The first contact member 370A and the second contact member 360A have a flat contact face 370Aa and a flat contact face 360Aa, respectively, to contact a front surface 31*a* serving as an image bearing surface of the intermediate transfer belt 31 serving as the image bearer. The number of the contact member having the flat contact face is not limited to two. At least one of the first contact member 370A and the second contact member 360A may be the contact member having the flat contact face. For example, one of the first contact member 370A and the second contact member 360A may be disposed in combination with one of the rollers 36 and 37 or one of the contact members 370 and 360 in the above-described embodiment. For example, as illustrated in FIG. 23, as the plurality of contact members, a first contact member 370B and a second contact member 360B of a semi-circular shape are disposed opposing the intermediate transfer belt 31. The first contact member 370B and the second contact member 360B have a curved contact face 370Ba and a curved contact face 360Ba, respectively, to contact a front surface 31*a* serving as an image bearing surface of the intermediate transfer belt 31 serving as the image bearer. The number of the contact member having the curved contact face is not limited to two. At least one of the first contact member 370B and the second contact member 360B may be the contact member having the flat contact face. For example, one of the first contact member 370B and the second contact member 360B may be disposed in combination with one of the rollers 36 and 37 or one of the contact members 370 and 360 in the above-described embodiment.

The stationary (nonrotatable) contact member 370, the first contact member 370A, or the first contact member 370B may be employed instead of the roller 37. Such a configuration reduces unnecessary vibration of the intermediate transfer belt 31, serving as a belt-shaped image bearer, upstream from the secondary transfer nip N, serving as the transfer section, in the delivery direction of a recording medium P. Alternatively, the stationary (nonrotatable) contact member 360, the second contact member 360A, or the first contact member 360B may be employed instead of the roller 36. Such a configuration reduces unnecessary vibration of the intermediate transfer belt 31, serving as a belt-shaped image bearer, upstream from the secondary transfer nip N, serving as the transfer section, in the delivery direction of a recording medium P. The number of contact members (rotators) disposed side by side at positions opposing the guide unit 50 serving as a guide unit is not limited to two. In some embodiments, three or more contact members (rotators) may be disposed at positions opposing the guide unit 50 serving as a guide unit.

Like the rollers 36 and 37, the contact member 360 and, the contact member 370, the first contact member 370A and the second contact member 360A, the first contact member 370B and the second contact member 360B may be disposed opposing a guide unit 50 including two guides, the first guide 51 and the second guide 52. Alternatively, in some embodiments, the guide unit 50 includes a single guide.

Although the embodiments of the present disclosure have been described above, the present disclosure is not limited to the embodiments described above, but a variety of modifications can naturally be made within the scope of the present disclosure. For example, the image forming apparatus is not limited to a color printer and may also be a printer, a facsimile machine, a plotter printer, or a multifunction peripheral having capabilities of a scanner and at least one of a printer, a facsimile machine, a plotter printer, or a copier. In the above-described embodiments, the guide unit 50 including two guides, the first guide 51 and the second guide 52, is disposed opposing the rollers 36 and 37. Alternatively, as described above, the guide unit 50 may be a guide unit including a single guide.

In the above descriptions, the image forming apparatus according to any of the above-described embodiments transfers images from the intermediate transfer belt 31 onto a recording medium P. Instead of such an image forming apparatus employing an intermediate transfer system, for example, the present invention is applicable to an apparatus (an image forming apparatus of a direct transfer system that directly transfers an image from an image bearer, such as a photoconductor drum or a photoconductor belt, onto a recording medium P. In the above-described embodiments, the secondary transfer belt 404 is employed as a transfer device. Alternatively, in some embodiments, instead of the secondary transfer belt 404, a secondary transfer roller may be employed as a transfer device. The transfer section may be a transfer device of a system having no transfer nip (e.g., a transfer charger of a charging system). In the above-described embodiments, the image forming apparatus conveys a recording medium P in a horizontal direction in the transfer section (the secondary transfer nip N). However, embodiments of this disclosure are not limited to the configuration of horizontal conveyance. For example, the present invention is applicable to an image forming apparatus that conveys a recording medium P in a transfer section upward, downward, diagonally upward, or diagonally downward.

The above-described effects of the embodiments and variations are only examples of effects obtained from the present invention, and the effects of the present invention are not limited to those described in the above-described embodiments and variations.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a belt-shaped image bearer having an image bearing surface to bear an image thereon;

a transferer forming a transfer section between the transferer and the image bearer, to transfer the image onto a recording medium;

a guide disposed upstream from the transfer section in a delivery direction of the recording medium, to guide the recording medium toward the transfer section;

two rotators disposed upstream from the transfer section in a moving direction of the image bearer and in contact with a non-image bearing surface of the image bearer opposite to the image bearing surface, a first rotator of the two rotators being closer to the transfer section than a second rotator of the two rotators; and a support to support the first rotator and the guide and to adjust a position of the first rotator and a position of the guide, the support including a bracket that rotates around an axis of rotation to adjust the position of the first rotator and the position of the guide, and the bracket supports the first rotator and the guide so that the first rotator is disposed closer to an end of the guide that is proximal to the transfer section than to an end of the guide that is distal to the transfer section, wherein the support adjusts the position of the first rotator and the position of the guide with a position of the second rotator being fixed.

2. The image forming apparatus according to claim 1, wherein the first rotator and the guide are movable together.

3. The image forming apparatus according to claim 1, wherein the support adjusts the position of the first rotator and the position of the guide with a gap between the image bearing surface of the image bearer and the guide being constant.

4. The image forming apparatus according to claim 1, wherein the first rotator and the guide are mounted to the bracket.

5. The image forming apparatus according to claim 1, further comprising a lever to swing the support.

6. The image forming apparatus according to claim 5, wherein the support rotates around a shaft by operating the lever.

7. The image forming apparatus according to claim 1, further comprising a drive motor to swing the support.

8. The image forming apparatus according to claim 7, wherein the support rotates around a shaft by driving the drive motor.

9. The image forming apparatus according to claim 1, wherein the guide includes a film made of resin.

10. The image forming apparatus according to claim 1, wherein the guide includes:

a first guide upstream from the transfer section in the delivery direction of the recording medium, to guide the recording medium toward the transfer section, a second guide upstream from the first guide in the delivery direction and spaced away from the first guide, to guide the recording medium toward the transfer section, and a mount to mount the first guide and the second guide.

11. An image forming apparatus, comprising:

a belt-shaped image bearer having an image bearing surface to bear an image thereon;

a transferer forming a transfer section between the transferer and the image bearer, to transfer the image onto a recording medium;

a guide disposed upstream from the transfer section in a delivery direction of the recording medium, to guide the recording medium toward the transfer section;

two rotators disposed upstream from the transfer section in a moving direction of the image bearer and in contact with a non-image bearing surface of the image bearer opposite to the image bearing surface, a first rotator of the two rotators being closer to the transfer section than a second rotator of the two rotators; and a support to support the first rotator and the guide and to adjust a position of the first rotator and a position of the guide, wherein the support adjusts the position of the first rotator and the position of the guide with a position of the second rotator being fixed.

12. The image forming apparatus according to claim 1, wherein the first rotator is disposed over the end of the guide that is proximal to the transfer section.

13. The image forming apparatus according to claim 1, wherein the bracket supports the first rotator, the second rotator, and the guide so that the first rotator, the second rotator, and the guide are rotatable with the bracket.

14. The image forming apparatus according to claim 1, wherein the axis of rotation of the bracket is disposed between a position of the bracket at which the first rotator is supported and an end of the bracket that is actuated on to rotate the bracket.

15. An image forming apparatus, comprising:

a belt-shaped image bearer having an image bearing surface to bear an image thereon;

a transferer forming a transfer section between the transferer and the image bearer, to transfer the image onto a recording medium;

a guide disposed upstream from the transfer section in a delivery direction of the recording medium, to guide the recording medium toward the transfer section;

two rotators disposed upstream from the transfer section in a moving direction of the image bearer and in contact with a non-image bearing surface of the image bearer opposite to the image bearing surface, a first rotator of the two rotators being closer to the transfer section than a second rotator of the two rotators; and a support to support the first rotator and the guide and to adjust a position of the first rotator and a position of the guide, the support including a bracket that rotates around an axis of rotation to adjust the position of the first rotator and the position of the guide, and the bracket supports the first rotator and the guide so that the first rotator is disposed closer to an end of the guide that is proximal to the transfer section than to an end of the guide that is distal to the transfer section, wherein the axis of rotation of the bracket is disposed between a position of the bracket at which the first rotator is supported and an end of the bracket that is actuated on to rotate the bracket.

* * * * *